US011482178B2

(12) United States Patent
Lee et al.

(10) Patent No.: US 11,482,178 B2
(45) Date of Patent: Oct. 25, 2022

(54) GATE DRIVING CIRCUIT, DISPLAY DEVICE, AND GATE DRIVING METHOD

(71) Applicant: LG Display Co., Ltd., Seoul (KR)

(72) Inventors: HaeSeung Lee, Seoul (KR); MooKyoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/543,409

(22) Filed: Dec. 6, 2021

(65) Prior Publication Data

US 2022/0208105 A1 Jun. 30, 2022

(30) Foreign Application Priority Data

Dec. 24, 2020 (KR) ..... 10-2020-0183925

(51) Int. Cl.
*G09G 3/3266* (2016.01)

(52) U.S. Cl.
CPC ... *G09G 3/3266* (2013.01); *G09G 2310/0289* (2013.01); *G09G 2310/0291* (2013.01); *G09G 2310/08* (2013.01)

(58) Field of Classification Search
None
See application file for complete search history.

(56) References Cited

U.S. PATENT DOCUMENTS

2007/0262310 A1* 11/2007 Park ..... G09G 3/3659 257/59

* cited by examiner

*Primary Examiner* — Christopher J Kohlman
(74) *Attorney, Agent, or Firm* — Birch, Stewart, Kolasch & Birch, LLP

(57) ABSTRACT

A display device can include a display panel including a first gate line and a second gate line; and a gate driving circuit configured to output a first gate signal to the first gate line in synchronization with a first horizontal synchronization pulse, and output a second gate signal to the second gate line in synchronization with a second horizontal synchronization pulse after the first horizontal synchronization pulse, and adjust at least a portion of the first gate signal or at least a portion of the second gate signal so that an area under one pulse of the first gate signal is substantially equal to an area under one pulse of the second gate signal.

21 Claims, 22 Drawing Sheets

CLK1 ~ CLK 8 { Odd Clock signals: CLK1, CLK3, CLK5, CLK7
Even Clock Signals: CLK2, CLK4, CLK6, CLK8 }

GATE DRIVING CIRCUIT, DISPLAY DEVICE, AND GATE DRIVING METHOD

CROSS-REFERENCE TO RELATED APPLICATIONS

This application claims priority to Korean Patent Application No. 10-2020-0183925, filed in the Republic of Korea on Dec. 24, 2020, the entire contents of which are hereby incorporated by reference for all purposes as if fully set forth into the present application.

BACKGROUND

Field

The present disclosure relates to a gate driving circuit, a display device, and a gate driving method.

Description of the Related Art

As the information society develops, demand for a display device for displaying an image is increasing in various forms, and in recent years, various display devices such as a liquid crystal display device and an organic light emitting display device are used.

A conventional display device may charge a capacitor disposed in each of a plurality of sub-pixels arranged on a display panel and use the capacitors to drive the display. However, in the situation of a conventional display device, a phenomenon in which charging is insufficient in each sub-pixel may occur, resulting in a problem of deteriorating image quality.

In a conventional display device, if the size of the non-display area of the display panel can be reduced, the degree of freedom in design of the display device can be increased, and design quality can also be improved. However, it is not easy to reduce the non-display area of the display panel because various wires and circuits should be arranged in the non-display area of the display panel. Also, if the components and circuits are simplified in order to try decrease their foot print and reduce the bezel size, then the quality of driving and timing signals may be impaired, which can have an even bigger impact on large, high definition displays (e.g., UHD devices) or other devices having high resolution (e.g., VR and AR devices).

In addition, in the situation of a conventional display device, not only the image quality is degraded due to insufficient charging time, but also the gate driving may malfunction due to the characteristic variation of the gate signals, resulting in deterioration of the image quality.

SUMMARY OF THE DISCLOSURE

Embodiments of the present disclosure provide a gate driving circuit, a display device, and a gate driving method capable of preventing image quality deterioration due to a deviation in gate output characteristics.

Embodiments of the present disclosure can provide a gate driving circuit, a display device, and a gate driving method capable of reducing the size of an arrangement area of the gate driving circuit and preventing image quality deterioration due to a deviation in gate output characteristics, even if the gate driving circuit is disposed in the display panel as a built-in panel type.

Embodiments of the present disclosure can provide a gate driving circuit, a display device, and a gate driving method capable of preventing image quality deterioration due to a deviation in gate output characteristics without changing clock signals.

Embodiments of the present disclosure can provide a gate driving circuit, a display device, and a gate driving method having a gate output characteristic deviation compensation function capable of sensing a gate output characteristic deviation and removing or reducing an effect of the gate output characteristic deviation.

According to aspects of the present disclosure, a display device includes a display panel including a first gate line and a second gate line; and during a frame time, a gate driving circuit configured to output a first gate signal to the first gate line in synchronization with a first horizontal synchronization pulse and output a second gate signal to the second gate line in synchronization with a second horizontal synchronization pulse after the first horizontal synchronization pulse.

The first gate signal includes a first low level voltage section, a first rising section, a first high level voltage section, and a first falling section.

The first rising section is started after a first rising standby time elapses from a generation timing of the first horizontal synchronization pulse, and the first falling section is started after a first falling standby time elapses from the generation timing of the first horizontal synchronization pulse.

The second gate signal includes a second low level voltage section, a second rising section, a second high level voltage section, and a second falling section.

The second rising section is started after a second rising standby time elapses from a generation timing of the second horizontal synchronization pulse, and the second falling section is started after a second falling standby time elapses from the generation timing of the second horizontal synchronization pulse.

The first rising standby time is shorter than the second rising standby time, or the second falling standby time is shorter than the first falling standby time.

A voltage of the first high level voltage section may be lower than a voltage of the second high level voltage section.

In the first gate signal, a portion surrounded by the first rising section, the first high level voltage section, the first falling section and an extension line of the first low level voltage section may have a first area. In the second gate signal, a portion surrounded by the second rising section, the second high level voltage section, the second falling section and an extension line of the second low level voltage section can have a second area equal to the first area.

The gate driving circuit can output the first gate signal based on a first clock signal and output the second gate signal based on a second clock signal. The first clock signal and the second clock signal can have the same rising length and the same falling length.

The gate driving circuit can include a first gate output buffer circuit including a first clock input node to which a first clock signal is input, a low level voltage node to which a low level voltage is input, and a first gate output node to which the first gate signal is output; a second gate output buffer circuit including a second clock input node to which a second clock signal is input, a low level voltage node to which the low level voltage is input, and a second gate output node to which the second gate signal is output; and a control circuit for controlling the first gate output buffer circuit and the second gate output buffer circuit.

The first gate output buffer circuit can include a first pull-up transistor for controlling a connection between the first clock input node and the first gate output node, and a first pull-down transistor for controlling a connection between the low level voltage node and the first gate output node. The second gate output buffer circuit can include a second pull-up transistor for controlling a connection between the second clock input node and the second gate output node, and a second pull-down transistor for controlling a connection between the low level voltage node and the second gate output node.

A gate node of the first pull-up transistor and a gate node of the second pull-up transistor can be electrically connected. A gate node of the first pull-down transistor and a gate node of the second pull-down transistor can be electrically connected.

The gate driving circuit can further include a first dummy gate output buffer circuit including the first clock input node, the low level voltage node, and a first dummy gate output node to which a first dummy gate signal is output; and a second dummy gate output buffer circuit including the second clock input node, the low level voltage node, and a second dummy gate output node to which a second dummy gate signal is output.

The first dummy gate output buffer circuit can include a first dummy pull-up transistor for controlling a connection between the first clock input node and the first dummy gate output node, and a first dummy pull-down transistor for controlling a connection between the low level voltage node and the first dummy gate output node. The second dummy gate output buffer circuit can include a second dummy pull-up transistor for controlling a connection between the second clock input node and the second dummy gate output node, and a second dummy pull-down transistor for controlling a connection between the low level voltage node and the second dummy gate output node.

The display device can further include a first sensing capacitor coupled between the first dummy gate output node and the low level voltage node, and a second sensing capacitor coupled between the second dummy gate output node and the low level voltage node.

The display device can further include at least one analog-to-digital converter for measuring a voltage of the first dummy gate output node and measuring a voltage of the second dummy gate output node.

The display device can further include a compensation circuit capable of sensing a voltage change of the first dummy gate output node over time and sensing a voltage change of the second dummy gate output node over time.

The compensation circuit can compare a first sensing result of a voltage change over time of the first dummy gate output node and a second sensing result of a voltage change over time of the second dummy gate output node. And the compensation circuit can adjust at least one of the first rising standby time and the second rising standby time, or adjusts at least one of the first falling standby time and the second falling standby time, based on the comparison result.

The display device can further include a controller configured to output a generation clock signal including a plurality of generation pulses and a modulation clock signal including a plurality of modulation pulses, and a level shifter configured to output a first clock signal and a second clock signal. The first clock signal can rise in synchronization with a first generation pulse among the plurality of generation pulses, and can fall in synchronization with a first modulation pulse among the plurality of modulation pulses. The second clock signal can rise in synchronization with a second generation pulse among the plurality of generation pulses, and can fall in synchronization with a second modulation pulse among the plurality of modulation pulses.

The gate driving circuit can output the first gate signal based on the first clock signal and output the second gate signal based on the second clock signal.

The controller can be configured to control a pulse timing of at least one of the first generation pulse and second generation pulse such that the first rising standby time of the first gate signal is shorter than the second rising standby time of the second gate signal; or control a pulse timing of at least one of the first modulation pulse and second modulation pulse such that the second falling standby time of the second gate signal is shorter than the first falling standby time of the first gate signal.

According to aspects of the present disclosure, a gate driving circuit includes a first gate output buffer circuit configured to output a first gate signal based on a first clock signal to a first gate line in synchronization with a first horizontal synchronization pulse; a second gate output buffer circuit configured to output a second gate signal based on a second clock signal to a second gate line in synchronization with a second horizontal synchronization pulse after the first horizontal synchronization pulse; and a control circuit for controlling the first gate output buffer circuit and the second gate output buffer circuit.

The first gate signal includes a first low level voltage section, a first rising section, a first high level voltage section, and a first falling section.

The first rising section is started after a first rising standby time elapses from a generation timing of the first horizontal synchronization pulse, and the first falling section is started after a first falling standby time elapses from the generation timing of the first horizontal synchronization pulse.

The second gate signal includes a second low level voltage section, a second rising section, a second high level voltage section and a second falling section.

The second rising section is started after a second rising standby time elapses from a generation timing of the second horizontal synchronization pulse, and the second falling section is started after a second falling standby time elapses from the generation timing of the second horizontal synchronization pulse.

The first rising standby time is shorter than the second rising standby time, or the second falling standby time is shorter than the first falling standby time.

According to aspects of the present disclosure, a gate driving method includes: outputting a first gate signal to a first gate line in synchronization with a first horizontal synchronization pulse; and outputting a second gate signal to a second gate line in synchronization with a second horizontal synchronization pulse after the first horizontal synchronization pulse.

The first gate signal includes a first low level voltage section, a first rising section, a first high level voltage section, and a first falling section. The first rising section is started after a first rising standby time elapses from a generation timing of the first horizontal synchronization pulse, and the first falling section is started after a first falling standby time elapses from the generation timing of the first horizontal synchronization pulse.

The second gate signal includes a second low level voltage section, a second rising section, a second high level voltage section, and a second falling section. The second rising section is started after a second rising standby time elapses from a generation timing of the second horizontal synchronization pulse, and the second falling section is started after a second falling standby time elapses from the generation timing of the second horizontal synchronization pulse.

The first rising standby time is shorter than the second rising standby time, or the second falling standby time is shorter than the first falling standby time.

According to embodiments of the present disclosure, it is possible to provide the gate driving circuit, the display device, and the gate driving method capable of preventing image quality deterioration due to a deviation in gate output characteristics.

According to embodiments of the present disclosure, it is possible to provide the gate driving circuit, the display device, and the gate driving method capable of reducing the size of an arrangement area of the gate driving circuit and preventing image quality deterioration due to a deviation in gate output characteristics, even if the gate driving circuit is disposed in the display panel as a built-in panel type.

According to embodiments of the present disclosure, it is possible to provide the gate driving circuit, the display device, and the gate driving method capable of preventing image quality deterioration due to a deviation in gate output characteristics without changing clock signals.

According to embodiments of the present disclosure, it is possible to provide the gate driving circuit, the display device, and the gate driving method having a gate output characteristic deviation compensation function capable of sensing a gate output characteristic deviation and removing or reducing an effect of the gate output characteristic deviation.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EMBODIMENTS

Figure 1:
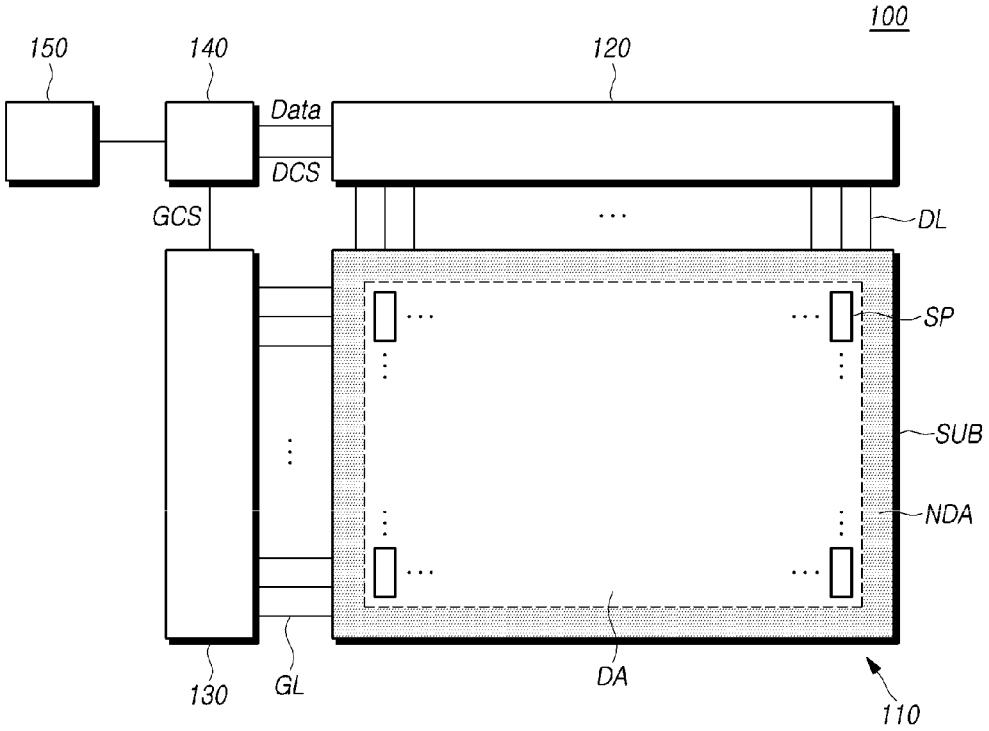
FIG. 1 is a system configuration diagram of a display device according to embodiments of the present disclosure.

In the following description of examples or embodiments of the present invention, reference will be made to the accompanying drawings in which it is shown, by way of illustration, specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to," "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc. each other via a fourth element.

Here, the second element may be included in at least one of two or more elements that "are connected or coupled to," "contact or overlap," etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can."

FIG. 1 is a system configuration diagram of a display device 100 according to embodiments of the present disclosure. All the components of each display device according to all embodiments of the present disclosure are operatively coupled and configured.

Referring to FIG. 1, the display device 100 according to the embodiments of the present disclosure can include a display panel 110 and a driving circuit for driving the display panel 110.

The driving circuit can include a data driving circuit 120 and a gate driving circuit 130, and can further include a controller 140 for controlling the data driving circuit 120 and the gate driving circuit 130.

The display panel 110 can include a substrate SUB and signal lines such as a plurality of data lines DL and a plurality of gate lines GL disposed on the substrate SUB. The display panel 110 can include a plurality of sub-pixels SP connected to a plurality of data lines DL and a plurality of gate lines GL.

The display panel 110 can include a display area DA in which an image is displayed and a non-display area NDA in which an image is not displayed. The plurality of sub-pixels SP for displaying an image can be disposed in the display area DA of the display panel 110. In the non-display area NDA of the display panel 110, at least one of the driving circuits 120, 130, and 140 can be electrically connected or at least one of the driving circuits 120, 130, and 140 can be mounted. A pad portion to which an integrated circuit or a printed circuit is connected can be disposed in the non-display area NDA of the display panel 110.

The data driving circuit 120 is a circuit for driving the plurality of data lines DL, and can supply data signals to the plurality of data lines DL. The gate driving circuit 130 is a circuit for driving the plurality of gate lines GL, and can supply gate signals to the plurality of gate lines GL. The controller 140 can supply a data control signal DCS to the data driving circuit 120 to control the operation timing of the data driving circuit 120. The controller 140 can supply a gate control signal GCS for controlling the operation timing of the gate driving circuit 130 to the gate driving circuit 130.

The controller 140 can start a scan according to timing implemented in each frame, and can control data drive at an appropriate time according to the scan. The controller 140 can convert input image data input from the outside according to a data signal format used by the data driving circuit 120 and supply the converted image data Data to the data driving circuit 120.

The controller 140 can receive various timing signals from the outside (e.g., host system 150) together with the input image data. For example, various timing signals can include a vertical synchronization signal (VSYNC), a horizontal synchronization signal (HSYNC), an input data enable signal DE, and a clock signal.

In order to control the data driving circuit 120 and the gate driving circuit 130, the controller 140 can receive the timing signals (e.g., VSYNC, HSYNC, DE, clock signal, etc.) to generate the various control signals (e.g., DCS, GCS, etc.), and can output the generated various control signals (e.g., DCS, GCS, etc.) to the data driving circuit 120 and the gate driving circuit 130.

For example, the controller 140 can output various gate control signals GCS including a gate start pulse (GSP), a gate shift clock (GSC), and a gate output enable signal (GOE) to control the gate driving circuit 130.

In addition, the controller 140 can output various data control signals DCS including a source start pulse (SSP), a source sampling clock (SSC), and a source output enable signal (SOE) to control the data driving circuit 120.

The controller 140 can be implemented as a separate component from the data driving circuit 120, or can be integrated with the data driving circuit 120 and implemented as an integrated circuit.

The data driving circuit 120 can drive the plurality of data lines DL by receiving image data Data from the controller 140 and supplying data voltages to the plurality of data lines DL. Here, the data driving circuit 120 is also referred to as a source driving circuit.

The data driving circuit 120 can include one or more source driver integrated circuits (SDICs).

Each source driver integrated circuit (SDIC) can include a shift register, a latch circuit, a digital to analog converter (DAC), an output buffer, and the like. Each source driver integrated circuit (SDIC) can further include an analog to digital converter (ADC) in some situations.

For example, each source driver integrated circuit (SDIC) can be connected to the display panel 110 in a TAB (Tape Automated Bonding) type, connected to a bonding pad of the display panel 110 in a COG (Chip On Glass) type or a COP (Chip On Panel) type, or implemented in a COF (Chip On Film) type to be connected to the display panel 110.

The gate driving circuit 130 can output a gate signal of a turn-on level voltage or a gate signal of a turn-off level voltage under the control of the controller 140. The gate driving circuit 130 can sequentially drive the plurality of gate lines GL by sequentially supplying a gate signal having a turn-on level voltage to the plurality of gate lines GL.

The gate driving circuit 130 can be connected to the display panel 110 in a TAB (Tape Automated Bonding) type, connected to a bonding pad of the display panel 110 in a COG (Chip On Glass) type or a COP (Chip On Panel) type, or implemented as a COF (Chip On Film) type to be connected to the display panel 110. Alternatively, the gate driving circuit 130 can be formed in the non-display area NDA of the display panel 110 in a GIP (Gate In Panel) type. The gate driving circuit 130 can be disposed on or connected to the substrate SUB. As described above, in the situation of the GIP type, the gate driving circuit 130 can be disposed in the non-display area NDA of the substrate SUB. The gate driving circuit 130 can be connected to the substrate SUB in the situation of a COG type, a COF type, or the like.

In addition, at least one of the data driving circuit 120 and the gate driving circuit 130 can be disposed in the display area DA. For example, at least one of the data driving circuit 120 and the gate driving circuit 130 can be disposed so as not to overlap the sub-pixels SP. Alternatively, at least one of the data driving circuit 120 and the gate driving circuit 130 can be disposed to partially or entirely overlap the sub-pixels SP.

When any one gate line GL is driven by the gate driving circuit 130, the data driving circuit 120 can convert the image data received from the controller 140 into an analog data voltage and supply the converted data voltage to the plurality of data lines DL.

The data driving circuit 120 can be connected to one side (e.g., an upper side, a lower side) of the display panel 110. Depending on the driving method, the panel design method, etc., the data driving circuit 120 can be connected to both sides (e.g., upper and lower sides) of the display panel 110 or to two or more of the four sides of the display panel 110.

The gate driving circuit 130 can be connected to one side (e.g., left or right) of the display panel 110. Depending on the driving method, the panel design method, etc., the gate driving circuit 130 can be connected to both sides (e.g., left and right) of the display panel 110 or to at least two of the four sides of the display panel 110.

The controller 140 can be a timing controller used in a display technology. Alternatively, the controller 140 can be a control device capable of further performing other control functions in addition to the functions of the timing controller. Alternatively, the controller 140 can be a control device different from the timing controller, or can be a circuit within the control device. For example, the controller 140 can be implemented with various circuits or electronic components, such as an integrated circuit (IC), a field programmable gate array (FPGA), an application specific integrated circuit (ASIC), or a processor.

The controller 140 can be mounted on a printed circuit board, a flexible printed circuit, etc., and can be electrically connected to the data driving circuit 120 and the gate driving circuit 130 through the printed circuit board, the flexible printed circuit, etc.

The controller 140 can transmit and receive signals to and from the data driving circuit 120 according to one or more predetermined interfaces. Here, for example, the interface can include a Low Voltage Differential Signaling (LVDS) interface, an EPI interface, and a Serial Peripheral Interface (SPI).

The controller 140 can include a storage medium, such as one or more registers.

The display device 100 according to embodiments of the present disclosure can be a display including a backlight unit such as a liquid crystal display, or a self-luminous display in which the display panel 110 emits light by itself. For example, the self-luminous display can be one of an organic light emitting diode (OLED) display, a quantum dot display, an inorganic-based light emitting diode display, and the like.

When the display device 100 according to embodiments of the present disclosure is an OLED display, each sub-pixel SP can include an organic light emitting diode (OLED) emitting light as a light emitting device. When the display device 100 according to the present example embodiment is a quantum dot display, each sub-pixel SP can include a light emitting device made of quantum dots, which are semiconductor crystals that emit light by themselves. When the display device 100 according to the present embodiments is an LED display, each sub-pixel SP emits light by itself and can include a micro LED (Micro Light Emitting Diode) made of an inorganic material as a light emitting device.

Figure 2A:
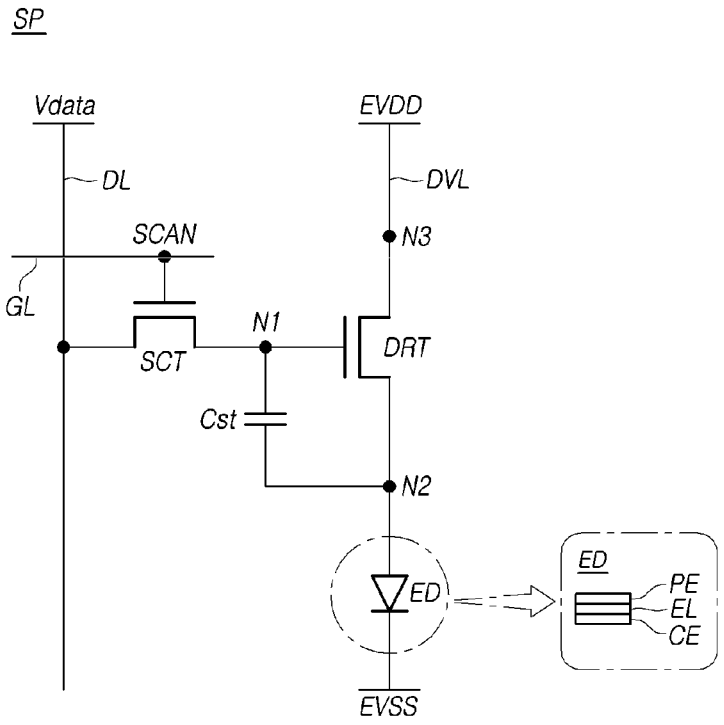
FIGS. 2A and 2B are equivalent circuits of a sub-pixel of the display device according to embodiments of the present disclosure.
Figure 2B:
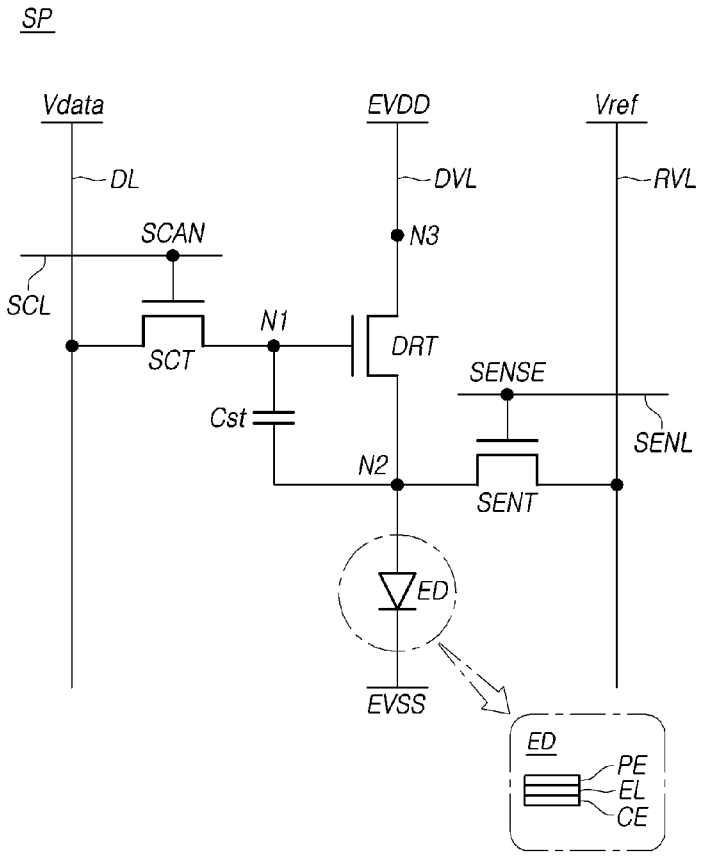

FIGS. 2A and 2B are equivalent circuits of sub-pixel SP of the display device 100 according to embodiments of the present disclosure.

Referring to FIG. 2A, each of the plurality of sub-pixels SP disposed on the display panel 110 of the display device 100 according to embodiments of the present disclosure can include a light emitting device ED, a driving transistor DRT, a scan transistor SCT, and a storage capacitor Cst.

Referring to FIG. 2A, the light emitting device ED can include a pixel electrode PE and a common electrode CE, and can include a light emitting layer EL positioned between the pixel electrode PE and the common electrode CE.

The pixel electrode PE of the light emitting device ED can be an electrode disposed in each sub-pixel SP, and the common electrode CE can be an electrode commonly disposed in all sub-pixels SP. Here, the pixel electrode PE can be an anode electrode and the common electrode CE can be a cathode electrode. Conversely, the pixel electrode PE can be a cathode electrode and the common electrode CE can be an anode electrode.

For example, the light emitting device ED can be an organic light emitting diode (OLED), a light emitting diode (LED), or a quantum dot light emitting device.

The driving transistor DRT can be a transistor for driving the light emitting device ED, and can include a first node N1, a second node N2, a third node N3, and the like.

The first node N1 of the driving transistor DRT can be a gate node of the driving transistor DRT, and can be electrically connected to a source node or a drain node of the scan transistor SCT. The second node N2 of the driving transistor DRT can be a source node or a drain node of the driving transistor DRT, and can be electrically connected to the pixel electrode PE of the light emitting device ED. The third node N3 of the driving transistor DRT can be electrically connected to the driving voltage line DVL supplying the driving voltage EVDD.

The scan transistor SCT is controlled by a scan signal SCAN, which is a type of a gate signal, and can be connected between the first node N1 of the driving transistor DRT and the data line DL. In other words, the scan transistor SCT can be turned on or off according to the scan signal SCAN supplied from the scan signal line SCL, which is one type of the gate line GL. Accordingly, the scan transistor SCT can control the connection between the data line DL and the first node N1 of the driving transistor DRT.

The scan transistor SCT can be turned on by the scan signal SCAN having a turn-on level voltage to transfer the data voltage Vdata supplied from the data line DL to the first node N1 of the driving transistor DRT.

Here, when the scan transistor SCT is an n-type transistor, the turn-on level voltage of the scan signal SCAN can be a high level voltage. When the scan transistor SCT is a p-type transistor, the turn-on level voltage of the scan signal SCAN can be a low level voltage.

The storage capacitor Cst can be connected between the first node N1 and the second node N2 of the driving transistor DRT. The storage capacitor Cst can be charged with an amount of charge corresponding to the voltage difference between the terminals, and can serve to maintain the voltage difference between the terminals for a predetermined frame time. Accordingly, during a predetermined frame time, the corresponding sub-pixel SP can emit light.

Referring to FIG. 2B, each of the plurality of sub-pixels SP disposed on the display panel 110 of the display device 100 according to embodiments of the present disclosure can further include a sensing transistor SENT.

The sensing transistor SENT can be controlled by a sense signal SENSE, which is a type of a gate signal, and can be connected between the second node N2 of the driving transistor DRT and the reference voltage line RVL. The sensing transistor SENT can be turned on or turned off according to the sense signal SENSE supplied from the sense signal line SENL, which is a type of the gate line GL, to control the connection between the reference voltage line RVL and the second node N2 of the driving transistor DRT.

The sensing transistor SENT can be turned on by the sense signal SENSE having a turn-on level voltage, and can transfer the reference voltage Vref supplied from the reference voltage line RVL to the second node N2 of the driving transistor DRT.

In addition, the sensing transistor SENT can be turned on by the sense signal SENSE having a turn-on level voltage to transfer the voltage of the second node N2 of the driving transistor DRT to the reference voltage line RVL. At this time, the reference voltage line RVL can be in a state to which the reference voltage Vref is not applied.

Here, when the sensing transistor SENT is an n-type transistor, the turn-on level voltage of the sense signal SENSE can be a high level voltage. When the sensing transistor SENT is a p-type transistor, the turn-on level voltage of the sense signal SENSE can be a low level voltage.

A function in which the sensing transistor SENT transfers the voltage of the second node N2 of the driving transistor DRT to the reference voltage line RVL can be used during driving to sense the characteristic value of the sub-pixel SP. In this situation, the voltage transferred to the reference voltage line RVL can be a voltage for calculating the characteristic value of the sub-pixel SP or a voltage in which the characteristic value of the sub-pixel SP is reflected.

In the present disclosure, the characteristic value of the sub-pixel SP can be a characteristic value of the driving transistor DRT or the light emitting device ED. The characteristic value of the driving transistor DRT can include a threshold voltage and mobility of the driving transistor DRT. The characteristic value of the light emitting device ED can include a threshold voltage of the light emitting device ED.

Each of the driving transistor DRT, the scan transistor SCT, and the sensing transistor SENT can be an n-type transistor or a p-type transistor. In the present disclosure, for convenience of description, it is assumed that each of the driving transistor DRT, the scan transistor SCT, and the sensing transistor SENT is an n-type.

The storage capacitor Cst may not be a parasitic capacitor (e.g., Cgs, Cgd) that is an internal capacitor existing between the gate node and the source node (or drain node) of the driving transistor DRT, but can be an external capacitor intentionally designed outside the driving transistor DRT.

The scan signal line SCL and the sense signal line SENL can be different gate lines GL. In this situation, the scan signal SCAN and the sense signal SENSE can be separate gate signals, the on-off timing of the scan transistor SCT and the on-off timing of the sensing transistor SENT in one sub-pixel SP can be independent. That is, the on-off timing of the scan transistor SCT and the on-off timing of the sensing transistor SENT in one sub-pixel SP can be the same or different.

Alternatively, the scan signal line SCL and the sense signal line SENL can be the same gate line GL. That is, the gate node of the scan transistor SCT and the gate node of the sensing transistor SENT in one sub-pixel SP can be connected to one gate line GL. In this situation, the scan signal SCAN and the sense signal SENSE can be the same gate signal, the on-off timing of the scan transistor SCT and the on-off timing of the sensing transistor SENT in one sub-pixel SP can be the same.

The structure of the sub-pixel SP shown in FIGS. 2A and 2B is merely an example, and the sub-pixel SP further includes one or more transistors or includes one or more capacitors and can be variously modified.

In addition, the sub-pixel structure illustrated in FIGS. 2A and 2B has been described on the assumption that the display device 100 is a self-luminous display device. When the display device 100 is a liquid crystal display, each sub-pixel SP can include a transistor and a pixel electrode.

Figure 3:
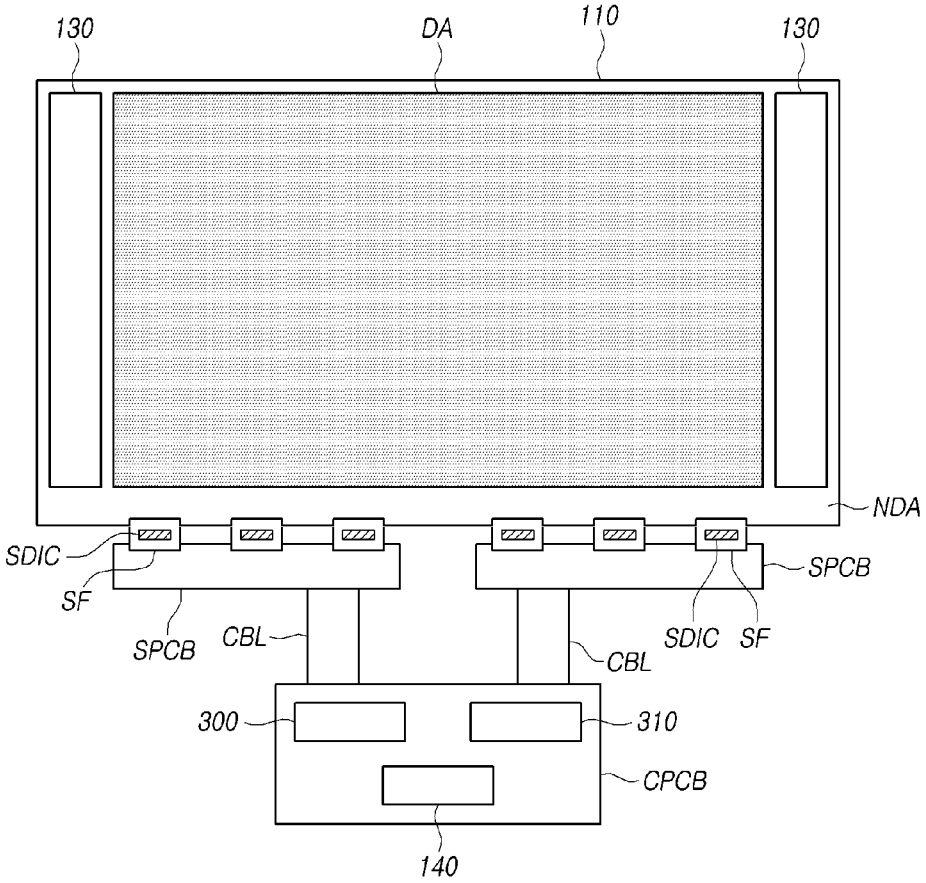
FIG. 3 is an example diagram illustrating a system implementation of the display device according to embodiments of the present disclosure.

FIG. 3 is an example diagram illustrating a system implementation of the display device 100 according to embodiments of the present disclosure.

Referring to FIG. 3, the display panel 110 can include the display area DA in which an image is displayed and the non-display area NDA in which an image is not displayed.

Referring to FIG. 3, when the data driving circuit 120 includes at least one source driver integrated circuit SDIC and is implemented as a COF (chip on film) type, each source driver integrated circuit SDIC can be mounted on the circuit film SF connected to the non-display area NDA of the display panel 110.

Referring to FIG. 3, the gate driving circuit 130 can be implemented as a GIP (gate in panel) type. In this situation, the gate driving circuit 130 can be formed in the non-display area NDA of the display panel 110. Alternatively, the gate driving circuit 130 can be implemented as a COF (Chip On Film) type.

The display device 100 can include at least one source printed circuit board SPCB for circuit connection between one or more source driver integrated circuits SDIC and other devices, and a control printed circuit board CPCB for mounting control elements (e.g., controller 140) and various electrical devices.

The circuit film SF on which the source driver integrated circuit SDIC is mounted can be connected to at least one source printed circuit board SPCB. More specifically, the source driver integrated circuit SDIC can be mounted on the circuit film SF. A portion of the circuit film SF can be electrically connected to the display panel 110, and another portion of the circuit film SF can be electrically connected to the source printed circuit board SPCB.

The controller 140 and a power management integrated circuit 310 can be mounted on the control printed circuit board CPCB. The controller 140 can perform overall control functions related to driving of the display panel 110, and can control operations of the data driving circuit 120 and the gate driving circuit 130. The power management integrated circuit 310 can supply various voltages or currents to the data driving circuit 120 and the gate driving circuit 130, or can control various voltages or currents to be supplied to the data driving circuit 120 and the gate driving circuit 130.

At least one source printed circuit board SPCB and the control printed circuit board CPCB can be electrically connected through at least one connection cable CBL. For example, the connection cable CBL can include a flexible printed circuit (FPC), a flexible flat cable (FFC), and the like.

At least one source printed circuit board SPCB and the control printed circuit board CPCB can be implemented by being integrated into one printed circuit board.

The display device 100 according to embodiments of the present disclosure can further include a level shifter 300 for adjusting a voltage level. For example, the level shifter 300 can be disposed on the control printed circuit board CPCB or the source printed circuit board SPCB.

In particular, in the display device 100 according to embodiments of the present disclosure, the level shifter 300 can supply signals necessary for gate driving to the gate driving circuit 130. For example, the level shifter 300 can supply a plurality of clock signals to the gate driving circuit 130. Accordingly, the gate driving circuit 130 can output the plurality of gate signals to the plurality of gate lines GL based on the plurality of clock signals input from the level shifter 300. The plurality of gate lines GL can transmit the plurality of gate signals to the sub-pixels SP disposed in the display area DA of the substrate SUB.

Figure 4:
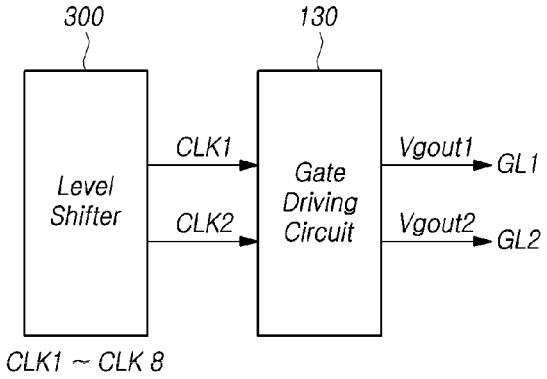
FIG. 4 illustrates a gate signal output system of the display device according to embodiments of the present disclosure.

FIG. 4 illustrates a gate signal output system of the display device 100 according to embodiments of the present disclosure.

Referring to FIG. 4, the level shifter 300 can output a first clock signal CLK1 and a second clock signal CLK2 to the gate driving circuit 130. The gate driving circuit 130 can generate and output the first gate signal Vgout1 and the second gate signal Vgout2 based on the first clock signal CLK1 and the second clock signal CLK2.

The first gate signal Vgout1 and the second gate signal Vgout2 can be respectively supplied to the first gate line GL1 and the second gate line GL2 disposed on the display panel 110. For example, each of the first gate signal Vgout1 and the second gate signal Vgout2 can be the scan signal SCAN applied to the gate node of the scan transistor SCT of FIG. 2A or 2B. As another example, each of the first gate signal Vgout1 and the second gate signal Vgout2 can be the sense signal SENSE applied to the gate node of the sensing transistor SENT of FIG. 2B.

For example, when the gate driving circuit 130 performs gate driving in 8 phases, the level shifter 300 can generate and output eight clock signals CLK1 to CLK8, and the gate driving circuit 130 can perform gate driving using eight clock signals CLK1 to CLK8.

Figure 5:
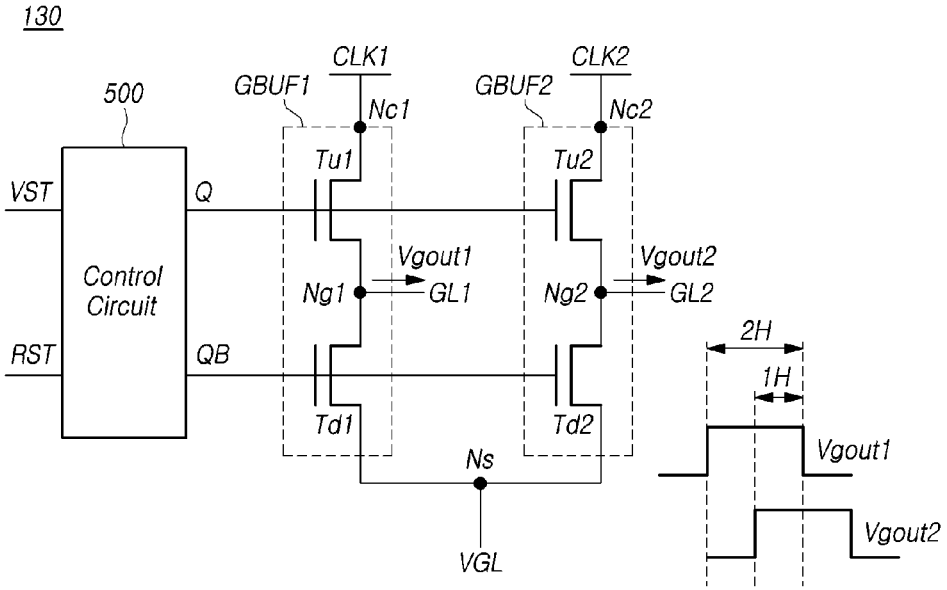
FIG. 5 is the gate driving circuit having a structure in which two gate output buffer circuits share one Q node in the display device according to embodiments of the present disclosure.

FIG. 5 is a gate driving circuit having a structure in which two gate output buffer circuits GBUF1 and GBUF2 share one Q node in the display device 100 according to embodiments of the present disclosure.

Referring to FIG. 5, the gate driving circuit 130 can receive the first clock signal CLK1 and the second clock signal CLK2, and can output the first gate signal Vgout1 and the second gate signal Vgout2 to the first gate line GL1 and the second gate line GL2 among the plurality of gate lines GL based on the first clock signal CLK1 and the second clock signal CLK2.

The first gate line GL1 and the second gate line GL2 to which the first gate signal Vgout1 and the second gate signal Vgout2 are applied can be disposed adjacent to each other.

Alternatively, the first gate line GL1 and the second gate line GL2 to which the first gate signal Vgout1 and the second gate signal Vgout2 are applied can be disposed apart from each other. In this situation, another gate line GL can be disposed between the first gate line GL1 and the second gate line GL2.

The gate drive circuit 130 can include a first gate output buffer circuit GBUF1, a second gate output buffer circuit GBUF2, and a gate output control circuit 500. The first gate output buffer circuit GBUF1 can output the first gate signal Vgout1 based on the first clock signal CLK1. The second gate output buffer circuit GBUF2 can output the second gate signal Vgout2 based on the second clock signal CLK2. The control circuit 500 can control the first gate output buffer circuit GBUF1 and the second gate output buffer circuit GBUF2.

The first gate output buffer circuit GBUF1 can include a first clock input node Nc1 to which the first clock signal CLK1 is input, a low level voltage node Ns to which a low level voltage VGL is input, and a first gate output node Ng1 to which the first gate signal Vgout1 is output.

The first gate output buffer circuit GBUF1 can include a first pull-up transistor Tu1 and a first pull-down transistor Td1. The first pull-up transistor Tu1 can control the electrical connection between the first clock input node Nc1 to which the first clock signal CLK1 is input and the first gate output node Ng1 to which the first gate signal Vgout1 is output. The first pull-down transistor Td1 can control the electrical connection between the first gate output node Ng1 to which the first gate signal Vgout1 is output and the low level voltage node Ns to which the low level voltage VGL is input.

The second gate output buffer circuit GBUF2 can include a second clock input node Nc2 to which the second clock signal CLK2 is input, a low level voltage node Ns to which the low level voltage VGL is input, and a second gate output node Ng2 to which the second gate signal Vgout2 is output.

The second gate output buffer circuit GBUF2 can include a second pull-up transistor Tu2 and a second pull-down transistor Td2. The second pull-up transistor Tu2 can control the electrical connection between the second clock input node Nc2 to which the second clock signal CLK2 is input and the second gate output node Ng2 to which the second gate signal Vgout2 is output. The second pull-down transistor Td2 can control the electrical connection between the second gate output node Ng2 to which the second gate signal Vgout2 is output and the low level voltage node Ns to which the low level voltage VGL is input.

The control circuit 500 can receive the start signal VST, the reset signal RST, and the like, and control the operations of the first gate output buffer circuit GBUF1 and the second gate output buffer circuit GBUF2. To this end, the control circuit 500 can control the voltage of the Q node and the voltage of the QB node.

The control circuit 500 can control the voltage of the Q node shared by the gate node of the first pull-up transistor Tu1 and the gate node of the second pull-up transistor Tu2. And the control circuit 500 can control the voltage of the QB node shared by the gate node of the first pull-down transistor Td1 and the gate node of the second pull-down transistor Td2.

The control circuit 500 can control the voltage of the QB node as a DC power supply.

The gate node of the first pull-up transistor Tu1 and the gate node of the second pull-up transistor Tu2 can be electrically connected. That is, the gate node of the first pull-up transistor Tu1 and the gate node of the second pull-up transistor Tu2 can be commonly connected to the Q node.

Therefore, by the voltage of the Q node controlled by the control circuit 500, the first pull-up transistor Tu1 of the first gate output buffer circuit GBUF1 and the second pull-up transistor Tu2 of the second gate output buffer circuit GBUF2 can be simultaneously turned on or turned off simultaneously.

The gate node of the first pull-down transistor Td1 and the gate node of the second pull-down transistor Td2 can be electrically connected. That is, the gate node of the first pull-down transistor Td1 and the gate node of the second pull-down transistor Td2 can be commonly connected to the QB node.

Therefore, by the voltage of the QB node controlled by the control circuit 500, the first pull-down transistor Td1 of the first gate output buffer circuit GBUF1 and the second pull-down transistor Td2 of the second gate output buffer circuit GBUF2 are simultaneously turned on or turned off simultaneously.

For example, when the gate driving circuit 130 performs gate driving in 8 phases, the level shifter 300 can generate and output eight clock signals CLK1, CLK2, CLK3, CLK4, CLK5, CLK6, CLK7, and CLK8. The gate driving circuit 130 can perform gate driving using eight clock signals CLK1, CLK2, CLK3, CLK4, CLK5, CLK6, CLK7, and CLK8.

As in the previous example, when the gate driving circuit 130 performs gate driving in 8 phases and has a structure in which two gate output buffer circuits GBUF1 and GBUF2 share one Q node, as shown in FIG. 5, the odd-numbered clock signals CLK1, CLK3, CLK5, and CLK7 among the eight clock signals CLK1 to CLK8 can have the same signal characteristics, and can be respectively input to the first gate output buffer circuits GBUF1 connected to different Q nodes to be used to generate gate signals. The even-numbered clock signals CLK2, CLK4, CLK6, and CLK8 among the eight clock signals CLK1 to CLK8 can have the same signal characteristics, and can be respectively input to the second gate output buffer circuits GBUF2 connected to different Q nodes to be used to generate gate signals.

Therefore, below, a representative clock signal of the odd-numbered clock signals CLK1, CLK3, CLK5, and CLK7 having the same signal characteristics will be described as a first clock signal CLK1. And a representative clock signal of the even-numbered clock signals CLK2, CLK4, CLK6, and CLK8 having the same signal characteristics is referred to as a second clock signal CLK2.

In addition, in the display device 100 according to embodiments of the present disclosure, the gate driving circuit 130 can perform overlap gate driving.

When the gate driving circuit 130 performs overlap gate driving, a high level voltage section of each of the first and second clock signals CLK1 and CLK2 can partially overlap. Accordingly, turn-on level voltage sections of the first gate signal Vgout1 and the second gate signal Vgout2 corresponding to successive driving timings can partially overlap. Here, the turn-on level voltage section of each of the first gate signal Vgout1 and the second gate signal Vgout2 can be a high level voltage section or a low level voltage section. Hereinafter, for convenience of description, the turn-on level voltage section of each of the first gate signal Vgout1 and the second gate signal Vgout2 will be described as the high level voltage section.

When the gate driving circuit 130 performs the overlap gate driving, the high level voltage section of the first gate signal Vgout1 and the high level voltage section of the second gate signal Vgout2 can partially overlap (e.g., see 1H in FIG. 5).

For example, each of the high level voltage section of the first gate signal Vgout1 and the high level voltage section of the second gate signal Vgout2 can have a temporal length of 2H. In this situation, an overlapping section in which the high level voltage section of the first gate signal Vgout1 and the high level voltage section of the second gate signal Vgout2 overlap can have a temporal length of 1H.

When the gate driving circuit 130 is of the GIP type and has a Q node sharing structure, the size of the bezel area (non-display area NDA) of the display panel 110 can be reduced. In addition, when the gate driving circuit 130 performs the overlap gate driving, the charging time of the storage capacitor Cst disposed in each of the plurality of sub-pixels SP can be increased to improve image quality.

Figure 6:
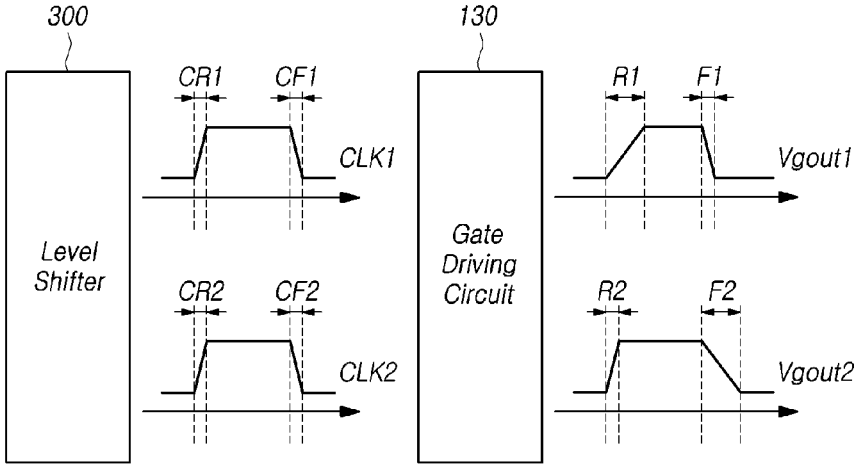
FIGS. 6 and 7 are diagrams illustrating variations in output characteristics of the gate driving circuit of FIG. 5 according to embodiments of the present disclosure.
Figure 7:
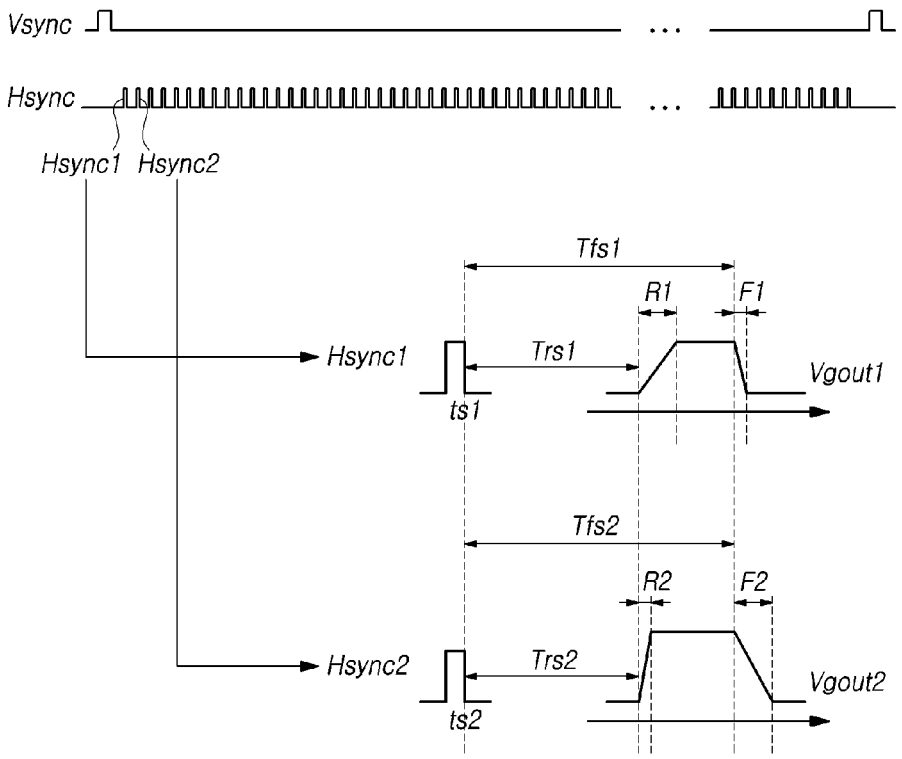

FIGS. 6 and 7 are diagrams illustrating variations in output characteristics of the gate driving circuit 130 of FIG. 5.

Referring to FIG. 6, the level shifter 300 can output a first clock signal CLK1 and a second clock signal CLK2. Here, the first clock signal CLK1 and the second clock signal CLK2 can have the same signal waveform and/or the same signal characteristics. For example, the rising length CR1 of the first clock signal CLK1 and the rising length CR2 of the second clock signal CLK2 can be equal to each other. The falling length CF1 of the first clock signal CLK1 and the falling length CF2 of the second clock signal CLK2 can be equal to each other.

When the gate driving circuit 130 uses the first clock signal CLK1 and the second clock signal CLK2 having the same signal waveform and/or the same signal characteristic, has a Q node sharing structure, and performs overlap gate driving, the first gate signal Vgout1 and the second gate signal Vgout2 output from the gate driving circuit 130 can have different signal waveforms (e.g., see Vgout1 and Vgout2 in FIG. 6).

For example, the falling length F1 of the first gate signal Vgout1 and the falling length F2 of the second gate signal Vgout2 can be different from each other (e.g., Vgout2 can be a mirror image of the signal waveform of Wgout1). The falling length described in this specification can be referred to as a falling time or a falling period.

For another example, the rising length R1 of the first gate signal Vgout1 and the rising length R2 of the second gate signal Vgout2 can be different from each other. The rising length described in this specification can be referred to as a rising time or a rising period.

The above-described output characteristic deviation between the first gate signal Vgout1 and the second gate signal Vgout2 can cause an operation difference between transistors (e.g., SCT, SENT) to which the first gate signal Vgout1 and the second gate signal Vgout2 are applied. As a result, a visual image defect phenomenon in the form of a horizontal line can be caused. Here, the output characteristic deviation can include one or more of a rising characteristic deviation and a falling characteristic deviation.

The first gate signal Vgout1 and the second gate signal Vgout2 are output from the gate driving circuit 130 at different timings. However, in FIG. 6, for convenience of explanation, it is shown that the rising start times of the first gate signal Vgout1 and the second gate signal Vgout2 coincide with each other and the falling start times of the first gate signal Vgout1 and the second gate signal Vgout2 coincide with each other. This will be described with reference to FIG. 7.

Referring to FIG. 7, the driving of one frame can be started in synchronization with the vertical synchronization pulse Vsync. The driving of each sub-pixel line in one frame can be started in synchronization with the horizontal synchronization pulse Hsync. Between two vertical synchronization pulses Vsync, there can be as many horizontal synchronization pulses Hsync as the number of sub-pixel rows. Here, the sub-pixel line can be referred to as a sub-pixel row or a scan signal line.

The gate driving circuit 130 can output the first gate signal Vgout1 in synchronization with the first horizontal synchronization pulse Hsync1, and can output the second gate signal Vgout2 in synchronization with the second horizontal synchronization pulse Hsync2.

The voltage rising of the first gate signal Vgout1 can be started after (when) the first rising standby time Trs1 elapses from the generation timing ts1 of the first horizontal synchronization pulse Hsync1. In addition, the voltage falling of the first gate signal Vgout1 can be started after (when) the first falling standby time Tfs1 elapses from the generation timing ts1 of the first horizontal synchronization pulse Hsync1.

The voltage rising of the second gate signal Vgout2 can be started after (when) the second rising standby time Trs2 elapses from the generation timing ts2 of the second horizontal synchronization pulse Hsync2. In addition, the voltage falling of the second gate signal Vgout2 can be started after (when) the second falling standby time Tfs2 elapses from the generation timing ts2 of the second horizontal synchronization pulse Hsync2.

In this specification, the coincidence of the rising start times of the first gate signal Vgout1 and the second gate signal Vgout2 can mean that the first rising standby time Trs1 and the second rising standby time Trs2 are the same.

In this specification, the coincidence of the falling start timings of the first gate signal Vgout1 and the second gate signal Vgout2 can mean that the first falling standby time Tfs1 and the second falling standby time Tfs2 are the same.

The display device 100 according to embodiments of the present disclosure can provide an effect of improving image quality by increasing an insufficient charging time in each sub-pixel by performing overlap gate driving. In addition, the display device 100 according to embodiments of the present disclosure can provide an effect of reducing the size of the bezel area (non-display area NDA) of the display panel 110 through the Q node sharing structure. The display device 100 according to embodiments of the present disclosure can simultaneously apply an overlap gate driving structure and a Q node sharing structure in order to provide both of the above two effects. The display device 100 according to embodiments of the present disclosure can alleviate or eliminate image quality degradation according to a characteristic deviation between gate signals Vgout1 and Vgout2 caused by simultaneous application of the overlap gate driving and the Q node sharing structure. Hereinafter, this will be described in detail.

In this specification, the characteristic deviation between the gate signals Vgout1 and Vgout2 can also be referred to as "a gate output characteristic deviation." In addition, a method for alleviating or eliminating the image quality deterioration phenomenon according to the characteristic deviation between the gate signals Vgout1 and Vgout2 is also referred to as "gate output characteristic deviation compensation."

The display device 100 according to embodiments of the present disclosure can include the display panel 110 including a first gate line GL1 and a second gate line GL2, and the gate driving circuit 130 for outputting a first gate signal Vgout1 to a first gate line GL1 based on a first clock signal CLK1 and outputting a second gate signal Vgout2 to a second gate line GL2 based on a second clock signal CLK2. The gate driving circuit 130 can output the first gate signal Vgout1 to the first gate line GL1 based on the first clock signal CLK1 in synchronization with the first horizontal synchronization pulse Hsync1. Also, the gate driving circuit 130 can output the second gate signal Vgout2 to the second gate line GL2 based on the second clock signal CLK2 in synchronization with the second horizontal synchronization pulse Hsync2 after the first horizontal synchronization pulse Hsync1.

Figure 8:
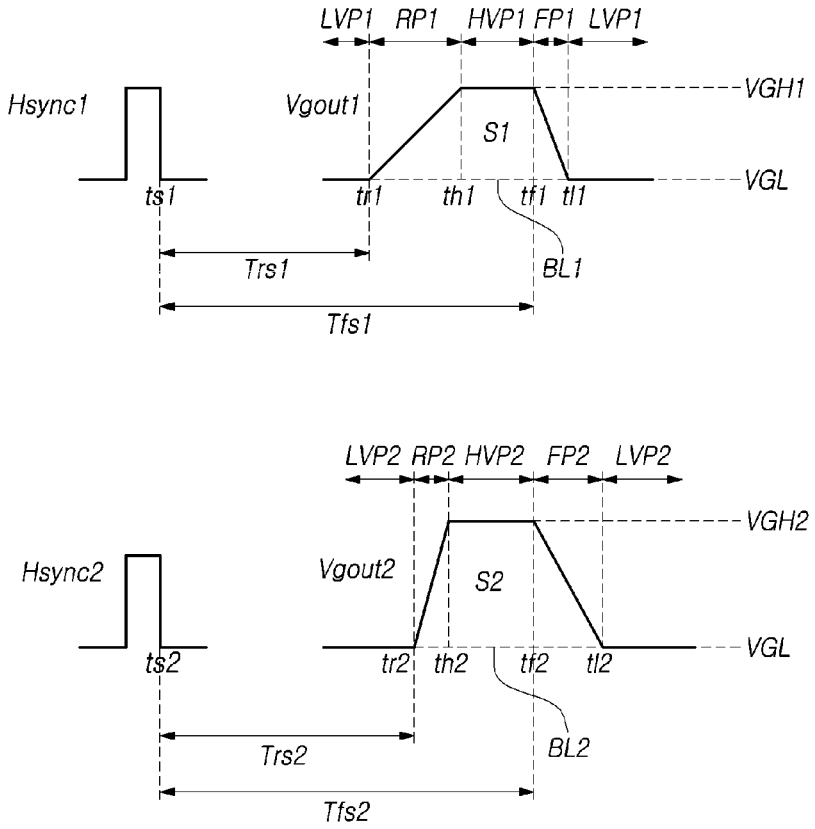
FIG. 8 illustrates a first gate signal and a second gate signal according to a first gate output characteristic deviation compensation method of the gate driving circuit according to embodiments of the present disclosure.

With reference to FIG. 8, during the first frame time, the first gate signal Vgout1 can include a first low level voltage section, a first rising section, a first high level voltage section, and a first falling section. And, during the first frame time, the second gate signal Vgout2 can include a second low level voltage section, a second rising section, a second high level voltage section, and a second falling section.

The first rising section of the first gate signal Vgout1 is a section in which the voltage of the first gate signal Vgout1 rises. The first rising section of the first gate signal Vgout1 can be started after the first rising standby time Trs1 has elapsed from the generation timing ts1 of the first horizontal synchronization pulse Hsync1.

The first falling section of the first gate signal Vgout1 is a section in which the voltage of the first gate signal Vgout1 falls. The first falling section of the first gate signal Vgout1 can be started after the first falling standby time Tfs1 has elapsed from the generation timing ts1 of the first horizontal synchronization pulse Hsync1.

The second rising section of the second gate signal Vgout2 is a section in which the voltage of the second gate signal Vgout2 rises. The second rising section of the second gate signal Vgout2 can be started after the second rising standby time Trs2 has elapsed from the generation timing ts2 of the second horizontal synchronization pulse Hsync2.

The second falling section of the second gate signal Vgout2 is a section in which the voltage of the second gate signal Vgout2 falls. The second falling section of the second gate signal Vgout2 can be started after the second falling standby time Tfs2 has elapsed from the generation timing ts2 of the second horizontal synchronization pulse Hsync2.

The display device 100 according to embodiments of the present disclosure can better control the rising start time and/or the falling start time of two gate signals Vgout1 and Vgout2 output from two gate output buffer circuits GBUF1 and GBUF2 sharing one Q node. Accordingly, the display device 100 according to embodiments of the present disclosure cancan compensate for the gate output characteristic deviation.

According to the gate output characteristic deviation compensation method according to the embodiments of the present disclosure, the first rising standby time Trs1 of the first gate signal Vgout1 can be shorter than the second rising standby time Trs2 of the second gate signal Vgout2, or the second falling standby time Tfs2 of the second gate signal Vgout2 can be shorter than the first falling standby time Tfs1 of the first gate signal Vgout1.

The gate output characteristic deviation compensation method according to the embodiments of the present disclosure can be a method of controlling the rising start time of two gate signals Vgout1 and Vgout2 output from two gate output buffer circuits GBUF1 and GBUF2 sharing one Q node. This method can be referred to as a first gate output characteristic deviation compensation method. In the situation of the first gate output characteristic deviation compensation method, the first rising standby time Trs1 of the first gate signal Vgout1 can be shorter than the second rising standby time Trs2 of the second gate signal Vgout2.

The gate output characteristic deviation compensation method according to the embodiments of the present disclosure can be a method of controlling the falling start time of two gate signals Vgout1 and Vgout2 output from two gate output buffer circuits GBUF1 and GBUF2 sharing one Q node. This method can be referred to as a second gate output characteristic deviation compensation method. In the situation of the second gate output characteristic deviation compensation method, the second falling standby time Tfs2 of the second gate signal Vgout2 can be shorter than the first falling standby time Tfs1 of the first gate signal Vgout1.

In the situation of the gate output characteristic deviation compensation method according to the embodiments of the present disclosure, degradation of image quality due to deviation in gate output characteristics can be prevented without changing the rising length or falling length of at least one of the first clock signal CLK1 and the second clock signal CLK2. Accordingly, according to the gate output characteristic deviation compensation method according to embodiments of the present disclosure, the rising length and the falling length of the first clock signal CLK1 can be the same as the rising length and the falling length of the second clock signal CLK2.

Hereinafter, the above-mentioned two gate output characteristic deviation compensation methods will be described in more detail.

Figure 9:
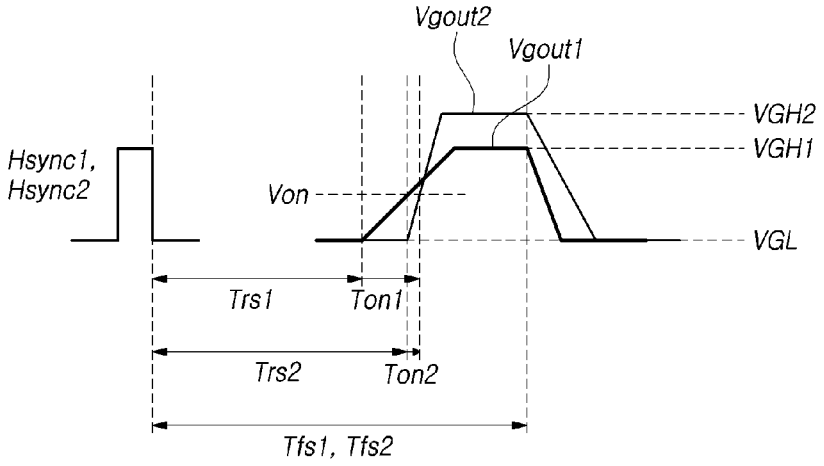
FIG. 9 shows the first gate signal and the second gate signal of FIG. 8 superimposed on each other according to embodiments of the present disclosure.

FIG. 8 illustrates a first gate signal Vgout1 and a second gate signal Vgout2 according to a first gate output characteristic deviation compensation method of the gate driving circuit 130 according to embodiments of the present disclosure. FIG. 9 shows the first gate signal Vgout1 and the second gate signal Vgout2 of FIG. 8 superimposed on each other. In the description below, the gate driving circuit 130 of FIG. 5 is referred to together.

Referring to FIGS. 8 and 9, during one frame time, the gate driving circuit 130 can output the first gate signal Vgout1 synchronized to the first horizontal synchronization pulse Hsync1 to the first gate line GL1, and output the second gate signal Vgout2 synchronized to the second horizontal synchronization pulse Hsync2 after the first horizontal synchronization pulse Hsync1 to the second gate line GL2.

In the gate driving circuit 130, the first gate output buffer circuit GBUF1 and the second gate output buffer circuit GBUF2 can share one Q node.

The first gate output buffer circuit GBUF1 can output the first gate signal Vgout1 based on the first clock signal CLK1 to the first gate line GL1 in synchronization with the first horizontal synchronization pulse Hsync1. The second gate output buffer circuit GBUF2 can output the second gate signal Vgout2 based on the second clock signal CLK2 to the second gate line GL2 in synchronization with the second horizontal synchronization pulse Hsync2 after the first horizontal synchronization pulse Hsync1.

The first gate signal Vgout1 can sequentially include a first low level voltage section LVP1, a first rising section RP1, a first high level voltage section HVP1, a first falling section FP1, and a first low level voltage section LVP1.

The first rising section RP1 of the first gate signal Vgout1 can be started after the first rising standby time Trs1 has elapsed from the generation timing ts1 of the first horizontal synchronization pulse Hsync1. The first falling section FP1 of the first gate signal Vgout1 can be started after the first falling standby time Tfs1 has elapsed from the generation timing ts1 of the first horizontal synchronization pulse Hsync1.

The first rising section RP1 of the first gate signal Vgout1 can be a signal period in which the voltage rises from the low level voltage VGL to the first high level voltage VGH1. The first rising section RP1 of the first gate signal Vgout1 can be a signal period from the first rising start time tr1 to the first high level arrival time th1.

The first high level voltage section HVP1 of the first gate signal Vgout1 can be a signal section in which the first high level voltage VGH1 is maintained. The first high level voltage section HVP1 of the first gate signal Vgout1 can be a signal section from the first high level arrival time th1 to the first falling start time tf1.

The first falling section FP1 of the first gate signal Vgout1 can be a signal period in which the voltage falls from the first high level voltage VGH1 to the low level voltage VGL. The first falling section FP1 of the first gate signal Vgout1 can be a signal section from the first falling start time tf1 to the first low level arrival time tl1.

The second gate signal Vgout2 can sequentially include a second low level voltage section LVP2, a second rising section RP2, a second high level voltage section HVP2, a second falling section FP2, and a second low level voltage section LVP2.

The second rising section RP2 of the second gate signal Vgout2 can be started after the second rising standby time Trs2 has elapsed from the generation timing ts2 of the second horizontal synchronization pulse Hsync2. The second falling section FP2 of the second gate signal Vgout2 can be started after the second falling standby time Tfs2 has elapsed from the generation timing ts2 of the second horizontal synchronization pulse Hsync2.

The second rising section RP2 of the second gate signal Vgout2 can be a signal section in which the voltage rises from the low level voltage VGL to the second high level voltage VGH2. The second rising section RP2 of the second gate signal Vgout2 can be a signal period from the second rising start time tr2 to the second high level arrival time th2.

The second high level voltage section HVP2 of the second gate signal Vgout2 can be a signal section in which the second high level voltage VGH2 is maintained. The second high level voltage section HVP2 of the second gate signal Vgout2 can be a signal section from the second high level arrival time th2 to the second falling start time tf2.

The second falling section FP2 of the second gate signal Vgout2 can be a signal period in which the voltage falls from the second high level voltage VGH2 to the low level voltage VGL. The second falling section FP2 of the second gate signal Vgout2 can be a signal section from the second falling start time tf2 to the second low level arrival time tl2.

Referring to FIGS. 8 and 9, the display device 100 according to embodiments of the present disclosure can include two gate output buffer circuits GBUF1 and GBUF2 sharing one Q node. Each of the two gate output buffer circuits GBUF1 and GBUF2 can output a first gate signal Vgout1 and a second gate signal Vgout2. The display device 100 according to embodiments of the present disclosure can control at least one of a rising start time tr1 of the first gate signal Vgout1 and a rising start time tr2 of the second gate signal Vgout2.

For example, the display device 100 according to embodiments of the present disclosure performs a rising control such that the first rising standby time Trs1 of the first gate signal Vgout1 is shorter than the second rising standby time Trs2 of the second gate signal Vgout2. This rising control can be a rising control for advancing the rising start time tr1 of the first gate signal Vgout1 or a rising control for delaying the rising start time tr2 of the second gate signal Vgout2.

Referring to FIGS. 8 and 9, a first time interval between the first rising start time tr1 of the first rising section RP1 and the first falling start time tf1 of the first falling section FP1 can be longer than a second time interval between the second rising start time tr2 of the second rising section RP2 and the second falling start time tf2 of the second falling section FP2.

The rising and falling characteristics of the gate signal can be as follows. As for the gate signal, the faster the rising speed, then the high level voltage will be higher and the falling speed will be slower. Conversely, the slower the rising speed of the gate signal, then the high level voltage will be lower and the falling speed will be faster (e.g., compare Vgout1 with Vgout2 in FIG. 8).

Accordingly, the rising speed of the second gate signal Vgout2 can be faster than the rising speed of the first gate signal Vgout1. The high level voltage VGH2 of the second gate signal Vgout2 can be higher than the high level voltage VGH1 of the first gate signal Vgout1. The falling speed of the second gate signal Vgout2 can be slower than the falling speed of the first gate signal Vgout1.

Conversely, the rising speed of the first gate signal Vgout1 can be slower than the rising speed of the second gate signal Vgout2. The high level voltage VGH1 of the first gate signal Vgout1 can be lower than the high level voltage VGH2 of the second gate signal Vgout2. The falling speed of the first gate signal Vgout1 can be faster than the falling speed of the second gate signal Vgout2.

Referring to FIGS. 8 and 9, the high level voltage VGH1 of the first gate signal Vgout1 can be lower than the high level voltage VGH2 of the second gate signal Vgout2. That is, the first high level voltage VGH1 of the first high level voltage section HVP1 can be lower than the second high level voltage VGH2 of the second high level voltage section HVP2.

Referring to FIGS. 8 and 9, in the first gate signal Vgout1, a portion surrounded by the extension line BL1 of the first low level voltage section LVP1, the first rising section RP1, the first high level voltage section HVP1, and the first falling section FP1 can have a first area S1. In the second gate signal Vgout2, a portion surrounded by the extension line BL2 of the second low level voltage section LVP2, the second rising section RP2, the second high level voltage section HVP2, and the second falling section FP2 can have a second area S2. The first area S1 and the second area S2 can be the same or have a difference within a preset range. Here, the preset range can be set by reflecting an error caused by internal/external factors in the system or an error caused by ambient noise or electromagnetic interference. For example, the preset range can be ±1%, ±2%, ±5%, etc., can be a fixed set value, or can be a value set variable according to circumstances (e.g., S1 can be equal to S2 within ±5%).

The display device 100 according to embodiments of the present disclosure can control the first rising standby time Trs1 of the first gate signal Vgout1 to be shorter than the second rising standby time Trs2 of the second gate signal Vgout2. The display device 100 according to embodiments of the present disclosure can perform a rising control for advancing the rising start time tr1 of the first gate signal Vgout1 or delaying the rising start time tr2 of the second gate signal Vgout2. In order to obtain the gate output characteristic deviation compensation effect through the aforementioned control, the first area S1 and the second area S2 should be the same or at least substantially the same (e.g., within ±5% or better). For example, according to an embodiment, the gate driving circuit can adjust at least a portion of the first gate signal Vgout1 and/or adjust at least a portion of the second gate signal Vgout2 so that an area under one pulse of the first gate signal is equal to or at least substantially equal to the area under one pulse of the second gate signal, even while the area under the one pulse of the first gate signal has a different shape (e.g., different starting or ending points for each of the pulses, different widths, different heights, etc.) than the area under the one pulse of the second gate signal.

The factors affecting the first area S1 can include the first rising start time tr1, the first high level arrival time th1, the first falling start time tf1, the first low level arrival time tl1, and the first high level voltage VGH1. The controllable factors among the factors affecting the first area S1 can include one or more of the first rising start time tr1 and the first falling start time tf1.

The factors affecting the second area S2 can include the second rising start time tr2, the second high level arrival time th2, the second falling start time tf2, the second low level arrival time tl2, and the second high level voltage VGH2. The controllable factor among the factors affecting the second area S2 can include one or more of the second rising start time tr2 and the second falling start time tf2.

The first gate output characteristic deviation compensation method can be a method of controlling at least one of the first rising start time tr1 and the second rising start time tr2 among the controllable factors tr1, tr2, tf1, and tf2.

According to the first gate output characteristic deviation compensation method, at least one of the rising start time tr1 of the first gate signal Vgout1 and the rising start time tr2 of the second gate signal Vgout2 is controlled or adjusted, so that the first area S1 and the second area S2 can be equal to each other or at least substantially equal to each other (e.g., within ±5% or better).

Referring to FIGS. 8 and 9, according to the first gate output characteristic deviation compensation scheme, the first rising standby time Trs1 can be shorter than the second rising standby time Trs2, and the first falling standby time Tfs1 of the first gate signal Vgout1 can be the same as the second falling standby time Tfs2 of the second gate signal Vgout2.

Referring to FIGS. 8 and 9, the first gate signal Vgout1 can become the turn-on level voltage Von when the first turn-on level arrival time Ton1 elapses after the first rising section RP1 starts. The second gate signal Vgout2 can become the turn-on level voltage Von when the second turn-on level arrival time Ton2 elapses after the second rising section RP2 starts.

Here, the turn-on level voltage Von of the first gate signal Vgout1 can be a minimum voltage capable of turning on the transistor (e.g., SCT and/or SENT) controlled by the first gate signal Vgout1. The turn-on level voltage Von of the first gate signal Vgout1 can be lower than the first high level voltage VGH1.

The turn-on level voltage Von of the second gate signal Vgout2 can be a minimum voltage capable of turning on the transistors (e.g., SCT and/or SENT) controlled by the second gate signal Vgout2. The turn-on level voltage Von of the second gate signal Vgout2 can be lower than the second high level voltage VGH2.

As shown in FIG. 9, the turn-on level voltage Von of the first gate signal Vgout1 can be the same as the turn-on level voltage Von of the second gate signal Vgout2. In some situations, the turn-on level voltage Von of the first gate signal Vgout1 can be different from the turn-on level voltage Von of the second gate signal Vgout2.

Referring to FIG. 9, the first turn-on level arrival time Ton1 can be longer than the second turn-on level arrival time Ton2.

Referring to FIG. 9, the first on-time (Trs1+Ton1) that is the sum of the first rising standby time Trs1 and the first turn-on level arrival time Ton1 can be equal to the second on-time (Trs2+Ton2) that is the sum of the second rising standby time Trs2 and the second turn-on level arrival time Ton2.

Figure 10:
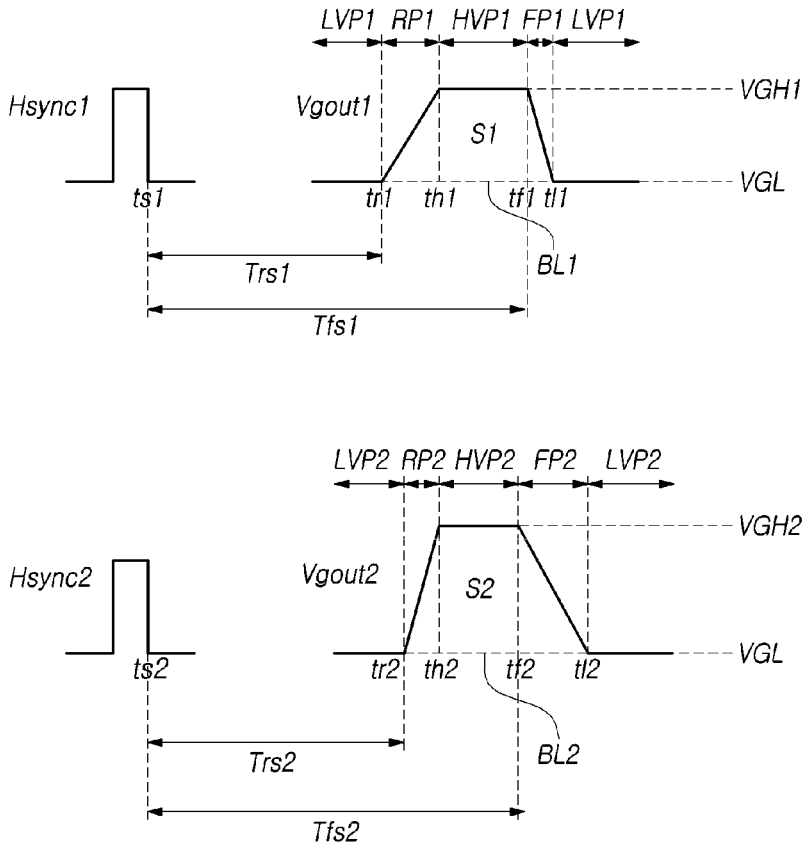
FIG. 10 illustrates a first gate signal and a second gate signal according to a second gate output characteristic deviation compensation method of the gate driving circuit according to embodiments of the present disclosure.
Figure 11:
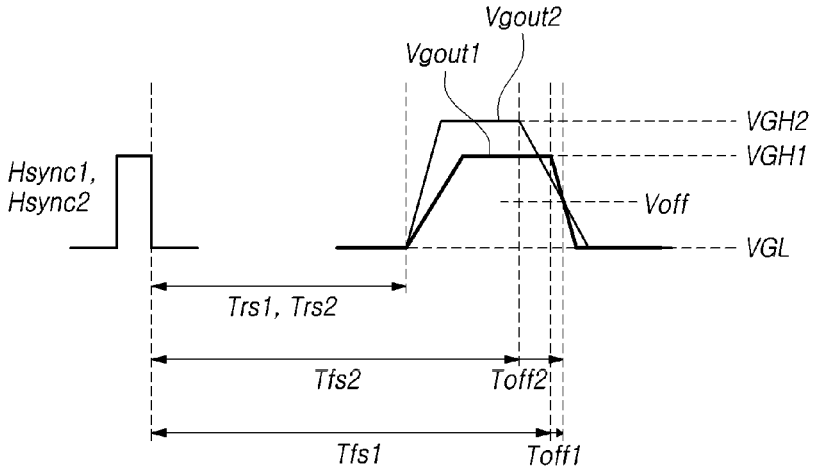
FIG. 11 shows the first gate signal and the second gate signal of FIG. 10 superimposed on each other according to embodiments of the present disclosure.

FIG. 10 illustrates a first gate signal Vgout1 and a second gate signal Vgout2 according to a second gate output characteristic deviation compensation method of the gate driving circuit 130 according to embodiments of the present disclosure. FIG. 11 shows the first gate signal Vgout1 and the second gate signal Vgout2 of FIG. 10 superimposed on each other. In the description below, the gate driving circuit 130 of FIG. 5 is referred to together.

Referring to FIGS. 10 and 11, for one frame time, the gate driving circuit 130 can output the first gate signal Vgout1 to the first gate line GL1 in synchronization with the first horizontal synchronization pulse Hsync1, and can output the second gate signal Vgout2 to the second gate line GL2 in synchronization with the second horizontal synchronization pulse Hsync2 after the first horizontal synchronization pulse Hsync1. That is, for one frame time, the gate driving circuit 130 can output the first gate signal Vgout1 synchronized to the first horizontal synchronization pulse Hsync1 to the first gate line GL1, and can output the second gate signal Vgout2 synchronized to the second horizontal synchronization pulse Hsync2 after the first horizontal synchronization pulse Hsync1 to the second gate line GL2.

In the gate driving circuit 130, the first gate output buffer circuit GBUF1 and the second gate output buffer circuit GBUF2 share one Q node.

The first gate output buffer circuit GBUF1 can output the first gate signal Vgout1 to the first gate line GL1 based on the first clock signal CLK1. An output timing of the first gate signal Vgout1 can be synchronized with the first horizontal synchronization pulse Hsync1.

The second gate output buffer circuit GBUF2 can output the second gate signal Vgout2 to the second gate line GL2 based on the second clock signal CLK2. An output timing of the second gate signal Vgout2 can be synchronized with the second horizontal synchronization pulse Hsync2 after the first horizontal synchronization pulse Hsync1.

The first gate signal Vgout1 can sequentially include a first low level voltage section LVP1, a first rising section RP1, a first high level voltage section HVP1, a first falling section FP1, and a first low level voltage section LVP1.

The first rising section RP1 of the first gate signal Vgout1 can be started after the first rising standby time Trs1 has elapsed from the generation timing ts1 of the first horizontal synchronization pulse Hsync1. The first falling section FP1 of the first gate signal Vgout1 can be started after the first falling standby time Tfs1 has elapsed from the occurrence timing ts1 of the first horizontal synchronization pulse Hsync1.

The first rising section RP1 of the first gate signal Vgout1 can be a signal period in which the voltage rises from the low level voltage VGL to the first high level voltage VGH1, and can be a signal period from the first rising start time tr1 to the first high level arrival time th1.

The first high level voltage section HVP1 of the first gate signal Vgout1 can be a signal period in which the first high level voltage VGH1 is maintained, and can be a signal period from the first high level arrival time th1 to the first falling start time tf1.

The first falling section FP1 of the first gate signal Vgout1 can be a signal period in which the voltage falls from the first high level voltage VGH1 to the low level voltage VGL, and can be a signal period from the first falling start time tf1 to the first low level arrival time tl1.

The second gate signal Vgout2 can sequentially include a second low level voltage section LVP2, a second rising section RP2, a second high level voltage section HVP2, a second falling section FP2, and a second low level voltage section LVP2.

The second rising section RP2 of the second gate signal Vgout2 can be started after the second rising standby time Trs2 has elapsed from the generation timing ts2 of the second horizontal synchronization pulse Hsync2. The second falling section FP2 of the second gate signal Vgout2 can be started after the second falling standby time Tfs2 has elapsed from the occurrence timing ts2 of the second horizontal synchronization pulse Hsync2.

The second rising section RP2 of the second gate signal Vgout2 can be a signal period in which the voltage rises from the low level voltage VGL to the second high level voltage VGH2, and can be a signal period from the second rising start time tr2 to the second high level arrival time th2.

The second rising section RP2 of the second gate signal Vgout2 can be a signal period in which the voltage rises from the low level voltage VGL to the second high level voltage VGH2, and can be a signal period from the second rising start time tr2 to the second high level arrival time th2.

The second falling section FP2 of the second gate signal Vgout2 can be a signal section in which the voltage falls from the second high level voltage VGH2 to the low level voltage VGL, and can be a signal section from the second falling start time tf2 to the second low level arrival time tl2.

Referring to FIGS. 10 and 11, the display device 100 according to embodiments of the present disclosure can control or adjust at least one of a falling start time tf1 of the first gate signal Vgout1 and a falling start time tf2 of the second gate signal Vgout2. The first gate signal Vgout1 and the second gate signal Vgout2 can be respectively output from the two gate output buffer circuits GBUF1 and GBUF2 sharing one Q node.

For example, the display device 100 according to embodiments of the present disclosure can perform polling control so that the second falling standby time Tfs2 of the second gate signal Vgout2 is shorter than the first falling standby time Tfs1 of the first gate signal Vgout1. The display device 100 according to embodiments of the present disclosure can perform falling control to advance the falling start time tf1 of the second gate signal Vgout2 or delay the falling start time tf2 of the first gate signal Vgout1.

Referring to FIGS. 10 and 11, the first time interval between the first rising start time tr1 of the first rising section RP1 and the first falling start time tf1 of the first falling section FP1 can be longer than the second time interval between the second rising start time tr2 of the second rising section RP2 and the second falling start time tf2 of the second falling section FP2.

The length of the first rising section RP1 of the first gate signal Vgout1 can be longer than the length of the second rising section RP2 of the second gate signal Vgout2. That is, the first gate signal Vgout1 can rise more slowly than the second gate signal Vgout2.

The length of the first falling section FP1 of the first gate signal Vgout1 can be shorter than the length of the second falling section FP2 of the second gate signal Vgout2. That is, the first gate signal Vgout1 can fall faster than the second gate signal Vgout2.

The rising and falling characteristics of the gate signal are as follows. In the gate signal, the faster the rising speed, then the higher the high level voltage is to reach and the slower the falling speed will be. Conversely, in the gate signal, the slower the rising speed, then the lower the high level voltage will reach and the faster the falling speed will be.

Accordingly, the rising speed of the second gate signal Vgout2 is faster than the rising speed of the first gate signal Vgout1. The high level voltage VGH2 of the second gate signal Vgout2 can be higher than the high level voltage VGH1 of the first gate signal Vgout1. The falling speed of the second gate signal Vgout2 can be slower than the falling speed of the first gate signal Vgout1.

Conversely, the rising speed of the first gate signal Vgout1 can be slower than the rising speed of the second gate signal Vgout2. The high level voltage VGH1 of the first gate signal Vgout1 can be lower than the high level voltage VGH2 of the second gate signal Vgout2. The falling speed of the first gate signal Vgout1 can be faster than the falling speed of the second gate signal Vgout2.

Referring to FIGS. 10 and 11, the first high level voltage VGH1 of the first gate signal Vgout1 can be lower than the second high level voltage VGH2 of the second gate signal Vgout2. That is, the first high level voltage VGH1 of the first high level voltage section HVP1 can be lower than the second high level voltage VGH2 of the second high level voltage section HVP2.

Referring to FIGS. 10 and 11, in the first gate signal Vgout1, a portion surrounded by the extension line BL1 of the first low level voltage section LVP1, the first rising section RP1, the first high level voltage section HVP1, and the first falling section FP1 can have a first area S1. In the second gate signal Vgout2, a portion surrounded by the extension line BL2 of the second low level voltage section LVP2, the second rising section RP2, the second high level voltage section HVP2, and the second falling section FP2 can have a second area S2. The first area S1 and the second area S2 can be equal to each other, or at least substantially equal to each other.

The factors affecting the first area S1 can include the first rising start time tr1, the first high level arrival time th1, the first falling start time tf1, the first low level arrival time tl1, and the first high level voltage VGH1. The controllable factor among the factors affecting the first area S1 can include one or more of the first rising start time tr1 and the first falling start time tf1.

The factors affecting the second area S2 can include the second rising start time tr2, the second high level arrival time th2, the second falling start time tf2, the second low level arrival time tl2, and the second high level voltage VGH2. The controllable factor among the factors affecting the second area S2 can include one or more of the second rising start time tr2 and the second falling start time tf2.

The second gate output characteristic deviation compensation method can be a method of controlling one or more of the first falling start time tf1 and the second falling start time tf2 among the controllable factors tr1, tr2, tf1, and tf2.

According to the second gate output characteristic deviation compensation method, at least one of the first falling start time tf1 of the first gate signal Vgout1 and the second falling start time tf2 of the second gate signal Vgout2 is controlled or adjusted, so that the first areas S1 and the areas S2 can be equal to each other, or at least substantially equal to each other.

Referring to FIGS. 10 and 11, according to the second gate output characteristic deviation compensation method, the second falling standby time Tfs2 can be shorter than the first falling standby time Tfs1, and the first rising standby time Trs1 can be equal to the second rising standby time Trs2.

Referring to FIGS. 10 and 11, the first gate signal Vgout1 can become a turn-off level voltage Voff when the first turn-off level arrival time Toff1 elapses after the first falling section FP1 starts. The second gate signal Vgout2 can become the turn-off level voltage Voff when the second turn-off level arrival time Toff2 elapses after the second falling section FP2 starts.

The turn-off level voltage Voff of the first gate signal Vgout1 can be a maximum voltage capable of turning off the transistor (e.g., SCT, SENT) controlled by the first gate signal Vgout1, and can be lower than the first high level voltage VGH1 and higher than the low level voltage VGL.

The turn-off level voltage Voff of the second gate signal Vgout2 can be a maximum voltage capable of turning off the transistor (e.g., SCT, SENT) controlled by the second gate signal Vgout2, and can be lower than the second high level voltage VGH2 and higher than the low level voltage VGL.

As shown in FIG. 11, the turn-off level voltage Voff of the first gate signal Vgout1 can be the same as the turn-off level voltage Voff of the second gate signal Vgout2. In some situations, the turn-off level voltage Voff of the first gate signal Vgout1 and the turn-off level voltage Voff of the second gate signal Vgout2 can be different from each other.

Referring to FIG. 11, the second turn-off level arrival time Toff2 can be longer than the first turn-off level arrival time Toff1.

Referring to FIG. 11, the first off-time (Tfs1+Toff1) that is the sum of the first falling standby time Tfs1 and the first turn-off level arrival time Toff1 can be equal to the second off-time (Tfs2+Toff2) that is the sum of the second falling standby time Tfs2 and the second turn-off level arrival time Toff2.

As mentioned above, the display apparatus 100 according to embodiments of the present disclosure can provide a function of compensating for deviation in gate output characteristics. According to the gate output characteristic deviation compensation, the rising start time and/or the falling start time can be controlled or adjusted so that the first area S1 related to the first gate signal Vgout1 and the second area S2 related to the second gate signal Vgout2 are equal to each other, or at least substantially equal to each other.

The first gate output characteristic deviation compensation method can be to control the first rising start time tr1 and/or the second rising start time tr2 so that the first area S1 related to the first gate signal Vgout1 and the second area S2 related to the second gate signal Vgout2 are equal to each other.

The second gate output characteristic deviation compensation method can be to control the first falling start time tf1 and/or the second falling start time tf2 so that the first area S1 related to the first gate signal Vgout1 and the second area S2 related to the second gate signal Vgout2 are equal to each other.

Hereinafter, a method of calculating an area for a gate signal will be described with reference to FIGS. 12 and 13.

Figure 12:
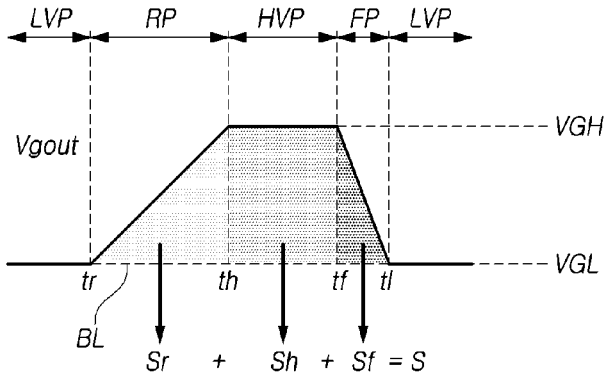
FIGS. 12 and 13 are diagrams for explaining a method of calculating an area for the gate signal for the gate output characteristics deviation compensating according to embodiments of the present disclosure.
Figure 13:
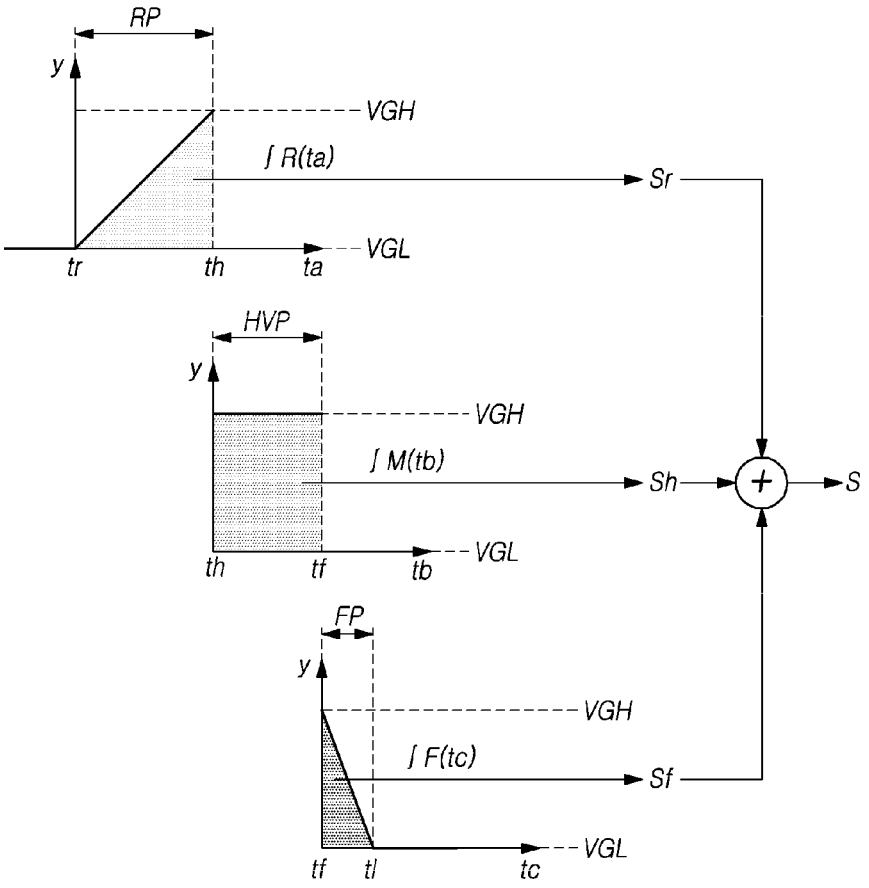

FIGS. 12 and 13 are diagrams for explaining a method of calculating an area for the gate signal for the gate output characteristics deviation compensating according to embodiments of the present disclosure. However, in FIGS. 12 and 13, an arbitrary gate signal Vgout is taken as an example. Any gate signal Vgout illustrated in FIGS. 12 and 13 can be one of the first gate signal Vgout1 and the second gate signal Vgout2.

The gate signal Vgout can sequentially include a low level voltage section LVP, a rising section RP, a high level voltage section HVP, a falling section FP and a low level voltage section LVP.

The rising section RP can be a signal section in which the voltage rises from the low level voltage VGL to the high level voltage VGH, and can be a signal section from the rising start time tr to the high level arrival time th.

The high level voltage section HVP can be a signal section in which the high level voltage VGH is maintained, and can be a signal section from the high level reaching time th to the falling start time tf.

The falling section FP can be a signal section in which the voltage falls from the high level voltage VGH to the low level voltage VGL, and can be a signal section from the falling start time tf to the low level arrival time tl.

In embodiments of the present disclosure, the area S of the gate signal Vgout means an area of a portion surrounded by the extension line BL of the low level voltage section LVP, the rising section RP, the high level voltage section HVP, and the falling section FP.

In embodiments of the present disclosure, the area S of the gate signal Vgout can be the sum of the area Sr of the rising section RP, the area Sh of the high level voltage section HVP, and the area Sf of the falling section FP.

Referring to FIG. 13, the area Sr of the rising section RP, the area Sh of the high level voltage section HVP, and the area Sf of the falling section FP can be calculated through integration processing.

Referring to FIG. 13, the controller 140 can acquire the area S of the gate signal Vgout by summing the area Sr of the rising section RP, the area Sh of the high level voltage section HVP, and the area Sf of the falling section FP calculated through the integration process.

Referring to FIG. 13, the controller 140 can obtain the area Sr of the rising section RP by integrating the rising function R(ta) for the rising section RP. The controller 140 can integrate with respect to the time range from the rising start time tr to the high level arrival time th when the rising function R(ta) is integrated.

The rising function R(ta) for the rising section RP is a function of voltage y for time ta, and can be expressed in Equation 1 below.

$$R(ta) = VGH - VGH \times e^{-\frac{ta}{R \cdot C}} \quad \text{[Equation 1]}$$

In Equation 1, VGH can be the voltage of the gate signal Vgout finally reached during the rising section RP. In addition, ta can be the time during the rising section RP as an integral variable, and can be changed from the rising start time tr to the high level arrival time th. R and C are a resistance value and a capacitance value of the gate line GL to which the gate signal Vgout is applied.

Referring to FIG. 13, the controller 140 can obtain the area Sh of the high level voltage section HVP by integrating the holding function M(tb) for the high level voltage section HVP. The controller 140 integrates with respect to the time range from the high level reaching time point th to the falling start time point tf at the time of integration of the maintenance function M(tb).

The maintenance function M(tb) for the high level voltage section (HVP) is a function of the voltage y with respect to the time tb, and can be expressed in Equation 2 below.

$$M(tb) = VGH \quad \text{[Equation 2]}$$

In Equation 2, VGH can be the voltage of the gate signal Vgout maintained during the high level voltage section HVP. In addition, tb can be the time during the high level voltage section HVP as an integral variable, and can be changed from the high level reaching time point th to the falling start time point tf. R and C are a resistance value and a capacitance value of the gate line GL to which the gate signal Vgout is applied.

Referring to FIG. 13, the controller 140 can obtain the area Sf of the falling section FP by integrating the falling function F(tc) for the falling section FP. The controller 140 integrates with respect to the time range from the falling start time tf to the low level arrival time tl at the time of integration of the falling function F(tc).

The falling function F(tc) for the falling section FP is a function of the voltage y for the time tc, and can be expressed in Equation 3 below.

$$F(tc) = VGH \times e^{-\frac{tc}{R \cdot C}} \quad \text{[Equation 3]}$$

In Equation 3, VGH can be the voltage of the gate signal Vgout just before the falling section FP starts. Also, tc can be the time during the falling section FP as an integral variable, and can be changed from the starting point of the falling tf to the time of reaching the low level tl. R and C are a resistance value and a capacitance value of the gate line GL to which the gate signal Vgout is applied.

In Equation 1, Equation 2 and Equation 3, R and C are constants already known as panel design values in advance.

The range of the integral variables ta, tb, and tc can be determined by the rising start time tr, the high level arrival time th, the falling start time tf, and the low level arrival time tl.

Among the rising start time tr, the high level arrival time th, the falling start time tf and the low level arrival time tl, the rising start time tr and the falling start time tf can be controlled factors, and can be information that the controller 140 already knows.

The controller 140 can sense a high level arrival time th and a low level arrival time tl through sensing processing. In addition, the controller 140 can sense the voltage VGH of the gate signal Vgout that finally arrives during the rising section RP through sensing processing.

Accordingly, the controller 140 can calculate the area Sr of the rising section RP, the area Sh of the high level voltage section HVP, and the area Sf of the falling section FP through integration processing using Equations 1 to 3, respectively. The controller 140 can calculate the area S of the gate signal Vgout by summing the calculated areas Sr, Sh, and Sf.

Below, a method and circuit for sensing the information (th, tl, VGH) necessary for area calculation and compensating for a deviation in gate output characteristics by using the sensing information will be described with reference to FIG. 14.

Figure 14:
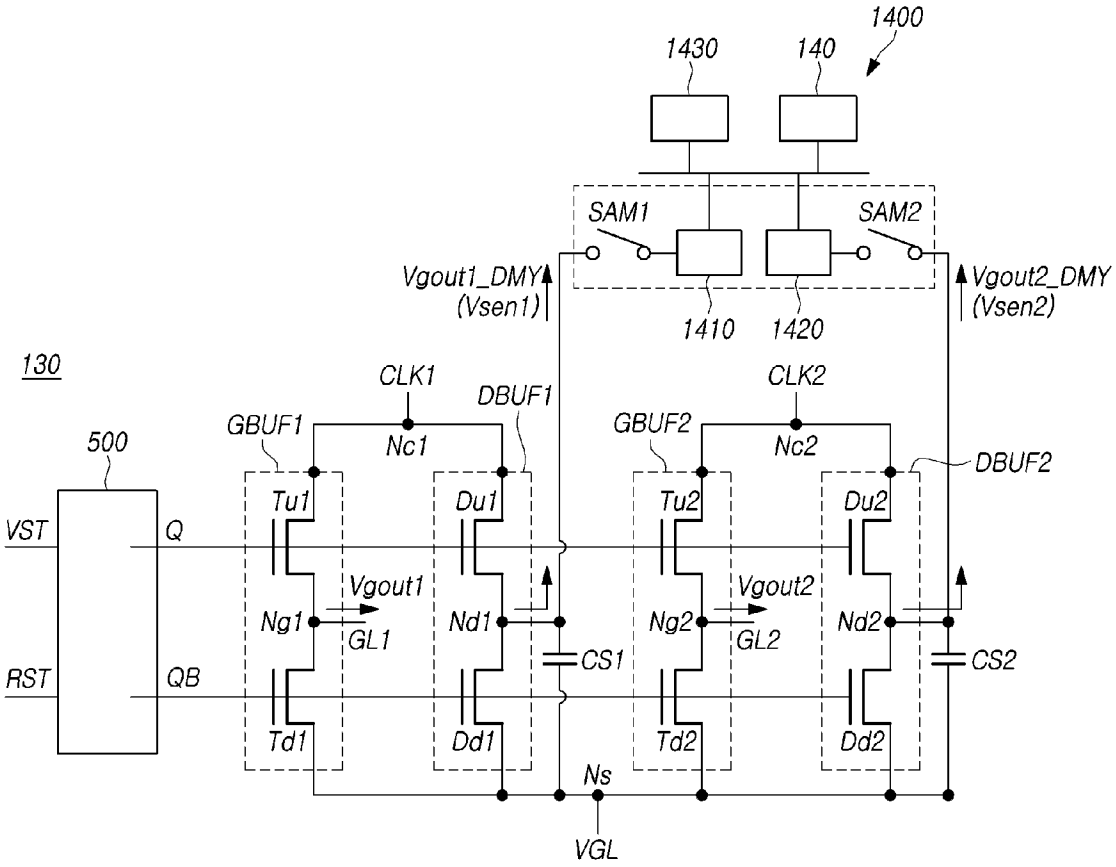
FIG. 14 illustrates a gate output characteristic deviation compensation circuit according to embodiments of the present disclosure.

FIG. 14 illustrates a gate output characteristic deviation compensation circuit according to embodiments of the present disclosure.

Referring to FIG. 14, the gate driving circuit 130 according to embodiments of the present disclosure can further include a first dummy gate output buffer circuit DBUF1 and a second dummy gate output buffer circuit DBUF2 to compensate for a deviation in gate output characteristics. The first dummy gate output buffer circuit DBUF1 can include a first clock input node Nc1, a low level voltage node Ns, and a first dummy gate output node Nd1 to which the first dummy gate signal Vgout1_DMY is output. The second dummy gate output buffer circuit DBUF2 can include a second clock input node Nc2, a low level voltage node Ns, and a second dummy gate output node Nd2 to which the second dummy gate signal Vgout2_DMY is output.

Referring to FIG. 14, the first dummy gate output buffer circuit DBUF1 can include a first dummy pull-up transistor Du1 that controls the connection between the first clock input node Nc1 and the first dummy gate output node Nd1, and a first dummy pull-down transistor Dd1 that controls the connection between the low level voltage node Ns and the first dummy gate output node Nd1.

Referring to FIG. 14, the second dummy gate output buffer circuit DBUF2 can include a second dummy pull-up transistor Du2 that controls the connection between the second clock input node Nc2 and the second dummy gate output node Nd2, and a second dummy pull-down transistor Dd2 that controls the connection between the low level voltage node Ns and the second dummy gate output node Nd2.

A gate node of the first dummy pull-up transistor Du1 can be electrically connected to a gate node of the first pull-up transistor Tu1. A gate node of the second dummy pull-up transistor Du2 can be electrically connected to a gate node of the second pull-up transistor Tu2. A gate node of each of the first pull-up transistor Tu1, the second pull-up transistor Tu2, the first dummy pull-up transistor Du1, and the second dummy pull-up transistor Du2 can be electrically connected to one Q node.

A gate node of the first dummy pull-down transistor Dd1 can be electrically connected to a gate node of the first pull-down transistor Td1. A gate node of the second dummy pull-down transistor Dd2 can be electrically connected to a gate node of the second pull-down transistor Td2. A gate node of each of the first pull-down transistor Td1, the second pull-down transistor Td2, the first dummy pull-down transistor Dd1, and the second dummy pull-down transistor Dd2 can be electrically connected to one QB node.

Referring to FIG. 14, the gate driving circuit 130 according to embodiments of the present disclosure can further include a first sensing capacitor CS1 and a second sensing capacitor CS2 to compensate for a deviation in gate output characteristics. The first sensing capacitor CS1 can be connected between the first dummy gate output node Nd1 and the low-level voltage node Ns. The second sensing capacitor CS2 can be connected between the second dummy gate output node Nd2 and the low level voltage node Ns.

The first sensing capacitor CS1 and the second sensing capacitor CS2 can have the same capacitance.

Referring again to FIG. 14, the display device 100 according to embodiments of the present disclosure can further include a compensation circuit 1400 for compensating for a deviation in gate output characteristics.

The compensation circuit 1400 can include a sensing processing circuit and a control circuit.

The sensing processing circuit can include a first analog-to-digital converter 1410, a first sampling switch SAM1, a second analog-to-digital converter 1420, and a second sampling switch SAM2.

The first sampling switch SAM1 can control an electrical connection between the first analog-to-digital converter 1410 and the first dummy gate output node Nd1.

The first analog-to-digital converter 1410 can sense the voltage Vgout1_MDY of the first dummy gate output node Nd1 electrically connected by the first sampling switch SAM1. The first analog-to-digital converter 1410 can convert the first sensing voltage Vsen1 corresponding to the sensed voltage Vgout1_MDY into a first sensing value corresponding to a digital value, and output the first sensing value.

The second sampling switch SAM2 can control an electrical connection between the second analog-to-digital converter 1420 and the second dummy gate output node Nd2.

The second analog-to-digital converter 1420 can sense the voltage Vgout2_MDY of the second dummy gate output node Nd2 electrically connected by the second sampling switch SAM2. The second analog-to-digital converter 1420 can convert the second sensed voltage Vsen2 corresponding to the sensed voltage Vgout1_MDY into a second sensing value corresponding to a digital value and output the second sensing value.

The first analog-to-digital converter 1410 and the second analog-to-digital converter 1420 can be implemented separately or integratedly.

The above-described sensing processing circuit can be included in the source driver integrated circuit (SDIC) of the data driving circuit 120.

The control circuit can include the controller 140 of FIG. 1 and the memory 1430.

The controller 140 can perform various calculation functions and control functions based on the first sensing value output from the first analog-to-digital converter 1410 and the second sensing value output from the second analog-to-digital converter 1420.

The memory 1430 can store the first sensing value output from the first analog-to-digital converter 1410 and the second sensing value output from the second analog-to-digital converter 1420. In addition, the memory 1430 can store various kinds of control information.

The memory 1430 can store control information (Trs1, Trs2, Tfs1, Tfs2, etc.) for compensating for the gate output characteristic deviation in the form of a look-up table (LUT: Lookup Table).

The controller 140 can sense information th, tl, and VGH for area calculation based on the first sensing value and the second sensing value. The controller 140 can calculate a first area S1 of the first gate signal Vgout1 and a second area S2 of the second gate signal Vgout2 by using the sensed information th, tl, and VGH. The controller 140 can perform calculation and control functions based on the calculated first area S1 and second area S2.

The controller 140 can check for a difference between the calculated first area S1 and the second area S2, and perform calculation and control functions so that the difference is eliminated or at least substantially reduced. The controller 140 can perform calculation and control functions such that the first area S1 of the first gate signal Vgout1 and the second area S2 of the second gate signal Vgout2 are equal.

According to the first gate output characteristic deviation compensation method, the controller 140 can compare the first sensing result and the second sensing result to adjust one or more of the first rising standby time Trs1 and the second rising standby time Trs2. Alternatively, according to the second gate output characteristic deviation compensation scheme, the controller 140 can adjust one or more of the first falling standby time Tfs1 and the second falling standby time Tfs2 by comparing the first sensing result and the second sensing result. The first sensing result can be a sensing result of a voltage change of the first dummy gate output node Nd1 according to time. The second sensing result can be a sensing result of a voltage change of the second dummy gate output node Nd2 according to time.

The controller 140 can use the first sensing values and the second sensing values obtained through a plurality of sensing processes to sense the information th, tl, and VGH values for area calculation.

The controller 140 can sense a voltage change of the first dummy gate output node Nd1 according to time and a voltage change of the second dummy gate output node Nd2 according to time by using a plurality of first sensing values and a plurality of second sensing values obtained for each time period through a plurality of sensing processes. Thereafter, the controller 140 can sense or estimate the high level arrival time th and the low level arrival time tl using the sensed result, and sense or estimate the voltage VGH of the gate signal Vgout that finally arrives during the rising section RP.

Figure 15:
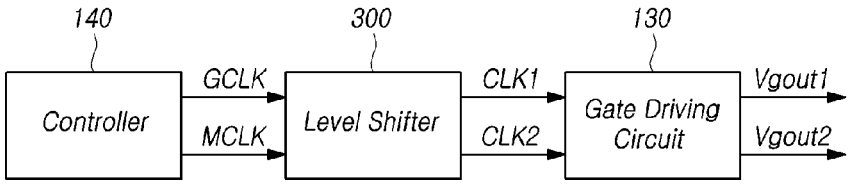
FIGS. 15 and 16 are diagrams for explaining execution methods for the gate output characteristic deviation compensation according to embodiments of the present disclosure.
Figure 15:
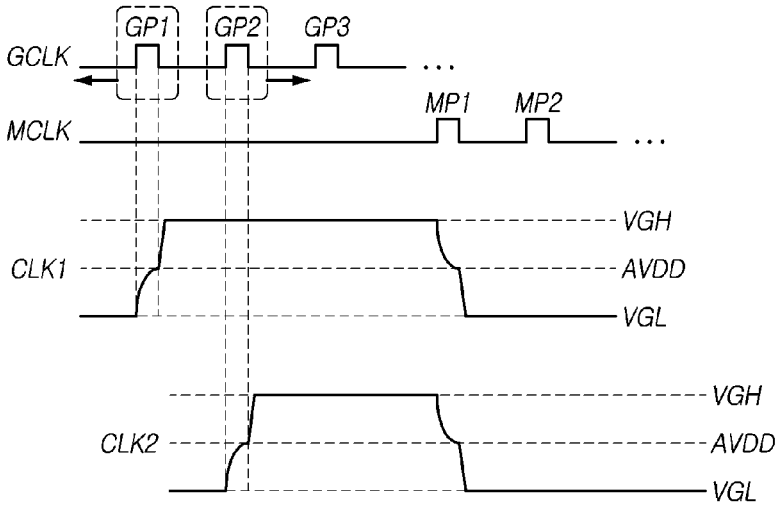
Figure 16:
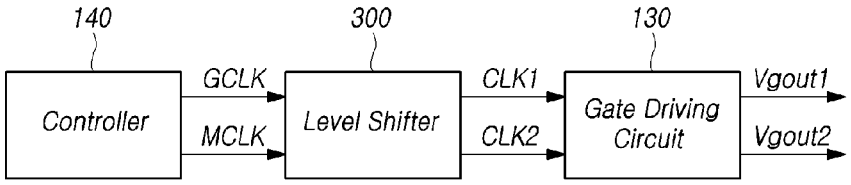
Figure 16:
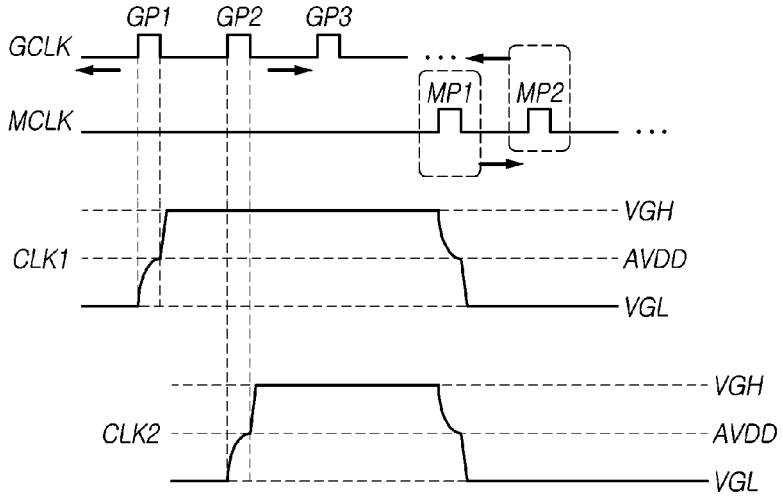

FIGS. 15 and 16 are diagrams for explaining execution methods for the gate output characteristic deviation compensation according to embodiments of the present disclosure.

Referring to FIGS. 15 and 16, the controller 140 can output a generation clock signal GCLK and a modulation clock signal MCLK. The generation clock signal GCLK can include a plurality of generation pulses (GP1, GP2, GP3 . . . ). The modulation clock signal MCLK can include a plurality of modulation pulses (MP1, MP2, MP3 . . . ).

Referring to FIGS. 15 and 16, the level shifter 300 can output a first clock signal CLK1 that rises in synchronization with the first generation pulse GP1 among the plurality of generation pulses (GP1, GP2, GP3 . . . ) and falls in synchronization with the first modulation pulse MP1 among the plurality of modulation pulses (MP1, MP2, MP3 . . . ). The level shifter 300 can output a second clock signal CLK2 that rises in synchronization with the second generation pulse GP2 among the plurality of generation pulses (GP1, GP2, GP3 . . . ) and falls in synchronization with the second modulation pulse MP2 of the plurality of modulation pulses (MP1, MP2, MP3 . . . ).

Referring to FIGS. 15 and 16, the gate driving circuit 130 can output the first gate signal Vgout1 based on the first clock signal CLK1 and output the second gate signal Vgout2 based on the second clock signal CLK2.

Referring to FIG. 15, the controller 140 can control the pulse timing of at least one of the first generation pulse GP1 and the second generation pulse GP2 so that the first rising standby time Trs1 of the first gate signal Vgout1 is shorter than the second rising standby time Trs2 of the second gate signal Vgout2.

Referring to FIG. 16, the controller 140 can control the pulse timing of at least one of the first modulation pulse MP1 and the second modulation pulse MP2 so that the second falling standby time Tfs2 of the second gate signal Vgout2 is shorter than the first falling standby time Tfs1 of the first gate signal Vgout1.

In the above, the gate output characteristic deviation compensation method has been described for the situation where the gate driving circuit 130 has a structure in which two gate output buffer circuits GBUF1 and GBUF2 share one Q node.

The gate output characteristic deviation compensation according to embodiments of the present disclosure can be equally applied to the gate driving circuit 130 having a structure in which one Q node is shared by three or more gate output buffer circuits.

Hereinafter, the gate driving circuit 130 having a structure in which one Q node is shared by four gate output buffer circuits and a gate output characteristic deviation compensation method applied thereto will be briefly described.

Figure 17:
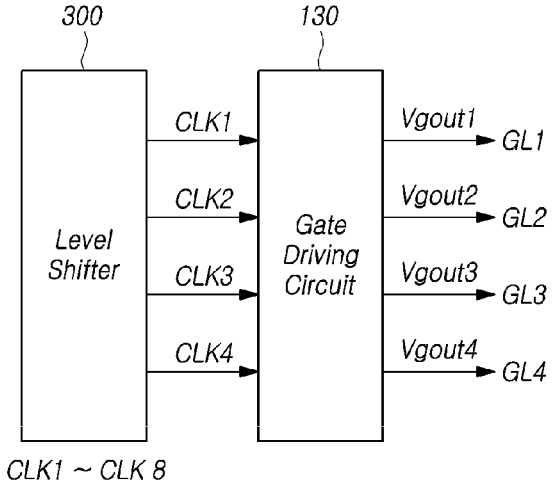
FIG. 17 illustrates another gate signal output system of the display device according to embodiments of the present disclosure.
Figure 18:
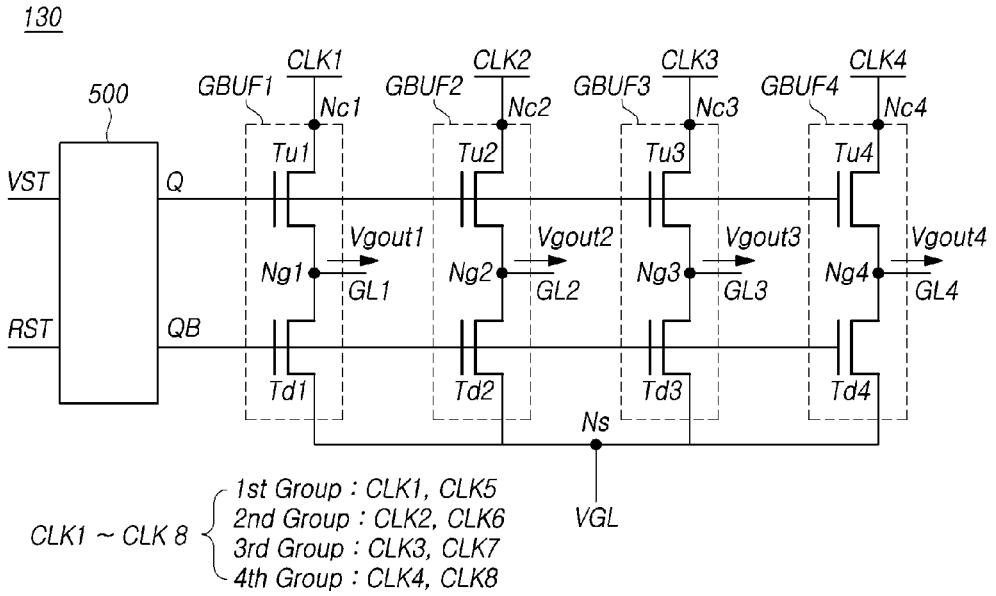
FIG. 18 is the gate driving circuit having a structure in which four gate output buffer circuits share one Q node in the display device according to embodiments of the present disclosure.

FIG. 17 illustrates another gate signal output system of the display device 100 according to embodiments of the present disclosure. FIG. 18 is the gate driving circuit 130 having a structure in which four gate output buffer circuits GBUF1 to GBUF4 share one Q node in the display device 100 according to embodiments of the present disclosure.

Referring to FIG. 17, the level shifter 300 can output four clock signals CLK1 to CLK4. The gate driving circuit 130 can output the four gate signals Vgout1 to Vgout4 to the four gate lines GL1 to GL4 based on the four clock signals CLK1 to CLK4.

Referring to FIG. 18, the gate driving circuit 130 can include first to fourth gate output buffer circuits GBUF1 to GBUF4 and a control circuit 500 for controlling the first to fourth gate output buffer circuits GBUF1 to GBUF4.

The first gate output buffer circuit GBUF1 can output the first gate signal Vgout1 to the first gate line GL1 through the first gate output node Ng1 based on the first clock signal CLK1 input to the first clock input node Nc1.

The first gate output buffer circuit GBUF1 can include a first pull-up transistor Tu1 and a first pull-down transistor Td1. The first pull-up transistor Tu1 can be electrically connected between the first clock input node Nc1 and the first gate output node Ng1 and can be controlled by the voltage of the Q node. The first pull-down transistor Td1 can be electrically connected between the first gate output node Ng1 and the low level voltage node Ns to which the low level voltage VGL is input, and can be controlled by the voltage of the QB node.

The second gate output buffer circuit GBUF2 can output the second gate signal Vgout2 to the second gate line GL2 through the second gate output node Ng2 based on the second clock signal CLK2 input to the second clock input node Nc2.

The second gate output buffer circuit GBUF2 can include a second pull-up transistor Tu2 and a second pull-down transistor Td2. The second pull-up transistor Tu2 can be electrically connected between the second clock input node Nc2 and the second gate output node Ng2 and can be controlled by the voltage of the Q node. The second pull-down transistor Td2 can be electrically connected between the second gate output node Ng2 and the low level voltage node Ns and can be controlled by the voltage of the QB node.

The third gate output buffer circuit GBUF3 can output the third gate signal Vgout3 to the third gate line GL3 through the third gate output node Ng3 based on the third clock signal CLK3 input to the third clock input node Nc3.

The third gate output buffer circuit GBUF3 can include a third pull-up transistor Tu3 and a third pull-down transistor Td3. The third pull-up transistor Tu3 can be electrically connected between the third clock input node Nc3 and the third gate output node Ng3 and can be controlled by the voltage of the Q node. The third pull-down transistor Td3 can be electrically connected between the third gate output node Ng3 and the low level voltage node Ns and can be controlled by the voltage of the QB node.

The fourth gate output buffer circuit GBUF4 can output the fourth gate signal Vgout4 to the fourth gate line GL4 through the fourth gate output node Ng4 based on the fourth clock signal CLK4 input to the fourth clock input node Nc4.

The fourth gate output buffer circuit GBUF4 can include a fourth pull-up transistor Tu4 and a fourth pull-down transistor Td4. The fourth pull-up transistor Tu4 can be electrically connected between the fourth clock input node Nc4 and the fourth gate output node Ng4 and can be controlled by the voltage of the Q node. The fourth pull-down transistor Td4 can be electrically connected between the fourth gate output node Ng4 and the low level voltage node Ns and can be controlled by the voltage of the QB node.

For example, when the gate driving circuit 130 performs gate driving in 8 phases, the level shifter 300 can generate and output 8 clock signals (CLK1, CLK2, CLK3, CLK4, CLK5, CLK6, CLK7, CLK8), and the gate driving circuit 130 can perform gate driving using the 8 clock signals (CLK1, CLK2, CLK3, CLK4, CLK5, CLK6, CLK7, CLK8). As in the above example, when the gate driving circuit 130 performs gate driving in 8 phases and has a structure in which four gate output buffer circuits GBUF1 to GBUF4 share one Q node as shown in FIG. 18, the eight clock signals (CLK1 to CLK8) can include a first group including first and fifth clock signals CLK1 and CLK5 having the same signal characteristics, a second group including second and sixth clock signals CLK2 and CLK6 having the same signal characteristics, a third group including third and seventh clock signals CLK3 and CLK7 having the same signal characteristics, and a fourth group including fourth and eighth clock signals CLK4 and CLK8 having the same signal characteristics. Each of the first to fourth groups can have different signal characteristics. The first and fifth clock signals CLK1 and CLK5 included in the first group can be input to the first gate output buffer circuits GBUF1 connected to different Q nodes to be used to generate gate signals. The second and sixth clock signals CLK2 and CLK6 included in the second group can be input to second gate output buffer circuits GBUF2 connected to different Q nodes to be used to generate gate signals. The third and seventh clock signals CLK3 and CLK7 included in the third group can be input to third gate output buffer circuits GBUF3 connected to different Q nodes to be used to generate gate signals. The fourth and eighth clock signals CLK4 and CLK8 included in the fourth group can be input to fourth gate output buffer circuits GBUF4 connected to different Q nodes to be used to generate gate signals. Accordingly, below, the first to fourth clock signals CLK1 to CLK4 are described as clock signals representing the first to fourth groups, respectively.

Figure 19:
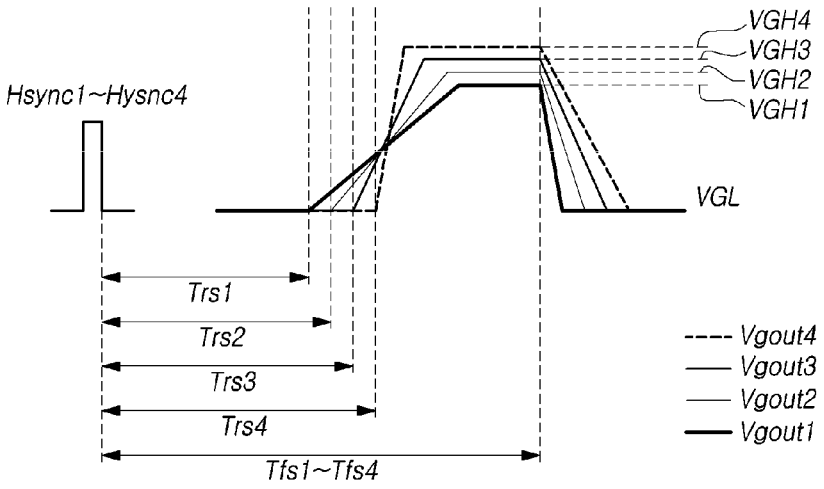
FIG. 19 illustrates a first gate signal, a second gate signal, a third gate signal, and a fourth gate signal according to a first gate output characteristic deviation compensation method of the gate driving circuit according to embodiments of the present disclosure.

FIG. 19 illustrates a first gate signal Vgout1, a second gate signal Vgout2, a third gate signal Vgout3, and a fourth gate signal Vgout4 according to a first gate output characteristic deviation compensation method of the gate driving circuit 130 according to embodiments of the present disclosure.

Referring to FIG. 19, during one frame time, the gate driving circuit 130 can output the first gate signal Vgout1, the second gate signal Vgout2, the third gate signal Vgout3, and the fourth gate signal Vgout4. That is, for one frame time, the gate driving circuit 130 can output the first gate signal Vgout1 synchronized to the first horizontal synchronization pulse Hsync1 to the first gate line GL1, can output the second gate signal Vgout2 synchronized to the second horizontal synchronization pulse Hsync2 after the first horizontal synchronization pulse Hsync1 to the second gate line GL2, can output the third gate signal Vgout3 synchronized to the third horizontal synchronization pulse Hsync3 after the second horizontal synchronization pulse Hsync2 to the third gate line GL3, and can output the fourth gate signal Vgout4 synchronized to the fourth horizontal synchronization pulse Hsync4 after the third horizontal synchronization pulse Hsync3 to the fourth gate line GL4.

The first gate signal Vgout1 can start rising after the first rising standby time Trs1 from the generation timing of the first horizontal synchronization pulse Hsync1.

The second gate signal Vgout2 can start rising after the second rising standby time Trs2 from the generation timing of the second horizontal synchronization pulse Hsync2.

The third gate signal Vgout3 can start rising after the third rising standby time Trs3 from the generation timing of the third horizontal synchronization pulse Hsync3.

The fourth gate signal Vgout4 can start rising after the fourth rising standby time Trs4 from the generation timing of the fourth horizontal synchronization pulse Hsync4.

The first rising standby time Trs1, the second rising standby time Trs2, the third rising standby time Trs3, and the fourth rising standby time Trs4 can be shorter in the order (Trs1<Trs2<Trs3<Trs4).

The first rising standby time Trs1 can be the shortest, and the fourth rising standby time Trs4 can be the longest.

The first gate signal Vgout1 can start falling after the first falling standby time Tfs1 from the generation timing of the first horizontal synchronization pulse Hsync1.

The second gate signal Vgout2 can start falling after the second falling standby time Tfs2 from the generation timing of the second horizontal synchronization pulse Hsync2.

The third gate signal Vgout3 can start falling after the third falling standby time Tfs3 from the generation timing of the third horizontal synchronization pulse Hsync3.

The fourth gate signal Vgout4 can start falling after the fourth falling standby time Tfs4 from the generation timing of the fourth horizontal synchronization pulse Hsync4.

The first falling standby time Tfs1, the second falling standby time Tfs2, the third falling standby time Tfs3 and the fourth falling standby time Tfs4 can all have the same length (Tfs1=Tfs2=Tfs3=Tfs4).

Referring to FIG. 19, the display device 100 according to embodiments of the present disclosure can control a rising start time of at least one of the first to fourth gate signals Vgout1 to Vgout4 so that the areas of each of the first to fourth gate signals Vgout1 to Vgout4 are the same. For example, each of the rising start times can be adjusted while each of the falling standby times remain the same.

Figure 20:
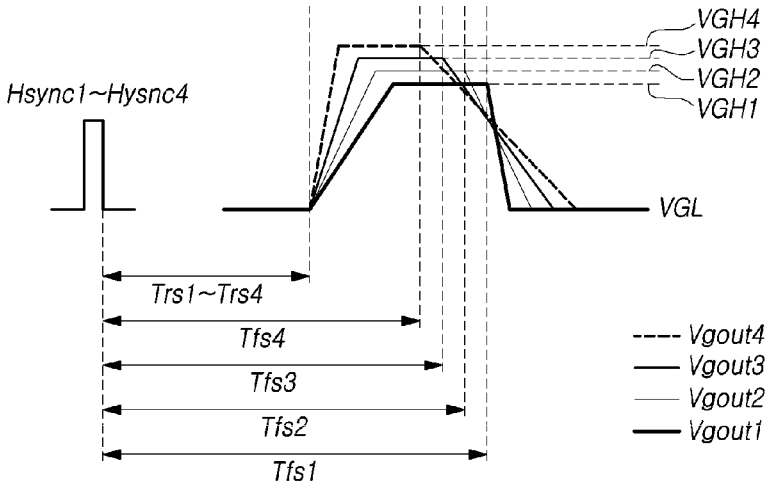
FIG. 20 illustrates a first gate signal, a second gate signal, a third gate signal, and a fourth gate signal according to a second gate output characteristic deviation compensation method of the gate driving circuit according to embodiments of the present disclosure.

FIG. 20 illustrates a first gate signal Vgout1, a second gate signal Vgout2, a third gate signal Vgout3, and a fourth gate signal Vgout4 according to a second gate output characteristic deviation compensation method of the gate driving circuit 130 according to embodiments of the present disclosure.

Referring to FIG. 20, during one frame time, the gate driving circuit 130 can output the first gate signal Vgout1, the second gate signal Vgout2, the third gate signal Vgout3, and the fourth gate signal Vgout4. That is, for one frame time, the gate driving circuit 130 can output the first gate signal Vgout1 synchronized to the first horizontal synchronization pulse Hsync1 to the first gate line GL1, can output the second gate signal Vgout2 synchronized to the second horizontal synchronization pulse Hsync2 after the first horizontal synchronization pulse Hsync1 to the second gate line GL2, can output the third gate signal Vgout3 synchronized to the third horizontal synchronization pulse Hsync3 after the second horizontal synchronization pulse Hsync2 to the third gate line GL3, and can output the fourth gate signal Vgout4 synchronized to the fourth horizontal synchronization pulse Hsync4 after the third horizontal synchronization pulse Hsync3 to the fourth gate line GL4.

The first gate signal Vgout1 can start rising after the first rising standby time Trs1 from the generation timing of the first horizontal synchronization pulse Hsync1.

The second gate signal Vgout2 can start rising after the second rising standby time Trs2 from the generation timing of the second horizontal synchronization pulse Hsync2.

The third gate signal Vgout3 can start rising after the third rising standby time Trs3 from the generation timing of the third horizontal synchronization pulse Hsync3.

The fourth gate signal Vgout4 can start rising after the fourth rising standby time Trs4 from the generation timing of the fourth horizontal synchronization pulse Hsync4.

The first rising standby time Trs1, the second rising standby time Trs2, the third rising standby time Trs3, and the fourth rising standby time Trs4 can all have the same length (Trs1=Trs2=Trs3=Trs4). For example, the first rising standby times can be held the same, while each of the falling standby times can be adjusted.

The first gate signal Vgout1 can start falling after the first falling standby time Tfs1 from the generation timing of the first horizontal synchronization pulse Hsync1.

The second gate signal Vgout2 can start falling after the second falling standby time Tfs2 from the generation timing of the second horizontal synchronization pulse Hsync2.

The third gate signal Vgout3 can start falling after the third falling standby time Tfs3 from the timing of occurrence of the third horizontal synchronization pulse Hsync3.

The fourth gate signal Vgout4 can start falling after the fourth falling standby time Tfs4 from the generation timing of the fourth horizontal synchronization pulse Hsync4.

The first falling standby time Tfs1, the second falling standby time Tfs2, the third falling standby time Tfs3 and the fourth falling standby time Tfs4 can be long in the order (Tfs1>Tfs2>Tfs3>Tfs4).

The fourth falling standby time Tfs4 can be the shortest, and the first falling standby time Tfs1 can be the longest.

Referring to FIG. 20, the display device 100 according to embodiments of the present disclosure can control a falling start time of at least one of the first to fourth gate signals Vgout1 to Vgout4 so that the areas of the first to fourth gate signals Vgout1 to Vgout4 are all the same.

Figure 21:
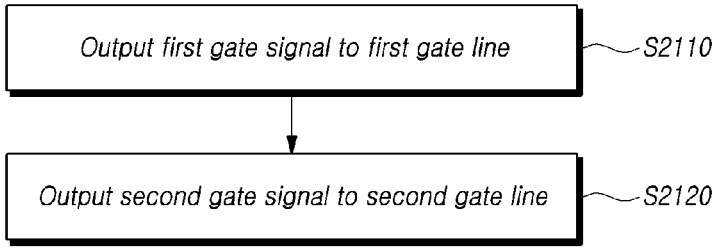
FIG. 21 is a flowchart of a gate driving method according to embodiments of the present disclosure.

FIG. 21 is a flowchart of a gate driving method according to embodiments of the present disclosure.

Referring to FIG. 21, the gate driving method according to embodiments of the present disclosure can include a first gate signal output step S2110 and a second gate signal output step S2120 and the like. In the first gate signal output step S2110, the gate driving circuit 130 can output the first gate signal Vgout1 to the first gate line GL1 in synchronization with the first horizontal synchronization pulse Hsync1. In the second gate signal output step S2120, the gate driving circuit 130 can output the second gate signal Vgout2 to the second gate line GL2 in synchronization with the second horizontal synchronization pulse Hsync2 after the first horizontal synchronization pulse Hsync1.

During the first frame time, the first gate signal Vgout1 can include a first low level voltage section LVP1, a first rising section RP1, a first high level voltage section HVP1, and a first falling section FP1 in order.

The first rising section RP1 of the first gate signal Vgout1 can be started after the first rising standby time Trs1 has elapsed from the generation timing ts1 of the first horizontal synchronization pulse Hsync1.

The first falling section FP1 of the first gate signal Vgout1 can be started after the lapse of the first falling standby time Tfs1 from the generation timing ts1 of the first horizontal synchronization pulse Hsync1.

During the first frame time, the second gate signal Vgout2 can include a second low level voltage section LVP2, a second rising section RP2, a second high level voltage section HVP2, and a second falling section FP2.

The second rising section RP2 of the second gate signal Vgout2 can be started after the second rising standby time Trs2 has elapsed from the generation timing ts2 of the second horizontal synchronization pulse Hsync2.

The second falling section FP2 of the second gate signal Vgout2 can be started after the second falling standby time Tfs2 has elapsed from the generation timing ts2 of the second horizontal synchronization pulse Hsync2.

The first rising standby time Trs1 of the first gate signal Vgout1 can be shorter than the second rising standby time Trs2 of the second gate signal Vgout2, or the second falling standby time Tfs2 of the second gate signal Vgout2 can be shorter than the first falling standby time Tfs1 of the first gate signal Vgout1.

At the first gate signal Vgout1, a region surrounded by the extension line BL1 of the first low level voltage section LVP1, the first rising section RP1, the first high level voltage section HVP1, and the first falling section FP1 can have a first area S1. At the second gate signal Vgout2, a region surrounded by the extension line BL2 of the second low level voltage section LVP2, the second rising section RP2, the second high level voltage section HVP2, and the second falling section FP2 can have a second area S2. The first area S1 and the second area S2 can be the same, or at least substantially the same.

If the first rising standby time Trs1 is shorter than the second rising standby time Trs2, then the first falling standby time Tfs1 can be equal to the second falling standby time Tfs2.

If the second falling standby time Tfs2 is shorter than the first falling standby time Tfs1, then the first rising standby time Trs1 can be equal to the second rising standby time Trs2.

According to embodiments of the present disclosure, it is possible to provide the gate driving circuit 130, the display device 100, and the gate driving method capable of preventing image quality deterioration due to a deviation in gate output characteristics.

According to embodiments of the present disclosure, it is possible to provide the gate driving circuit 130, the display device 100, and the gate driving method capable of reducing the size of an arrangement area of the gate driving circuit 130 and preventing image quality deterioration due to a deviation in gate output characteristics, even if the gate driving circuit 130 is disposed in the display panel 110 as a built-in panel type (GIP type).

According to embodiments of the present disclosure, it is possible to provide the gate driving circuit 130, the display device 100, and the gate driving method capable of preventing image quality deterioration due to a deviation in gate output characteristics without changing clock signals (CLK1, CLK2, etc.).

According to embodiments of the present disclosure, it is possible to provide the gate driving circuit 130, the display device 100, and the gate driving method having a gate output characteristic deviation compensation function capable of sensing a gate output characteristic deviation and removing or reducing an effect of the gate output characteristic deviation.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention.

Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel including a first gate line and a second gate line; and a gate driving circuit configured to:

output a first gate signal to the first gate line in synchronization with a first horizontal synchronization pulse, and output a second gate signal to the second gate line in synchronization with a second horizontal synchronization pulse after the first horizontal synchronization pulse, wherein the first gate signal includes a first low level voltage section, a first rising section, a first high level voltage section, and a first falling section, wherein the first rising section is started after a first rising standby time elapses from the first horizontal synchronization pulse, and the first falling section is started after a first falling standby time elapses the first horizontal synchronization pulse, the first rising standby time being shorter than the first falling standby time, wherein the second gate signal includes a second low level voltage section, a second rising section, a second high level voltage section, and a second falling section, wherein the second rising section is started after a second rising standby time elapses from the second horizontal synchronization pulse, and the second falling section is started after a second falling standby time elapses from the second horizontal synchronization pulse, the second rising standby time being shorter than the second falling standby time, and wherein the first rising standby time is shorter than the second rising standby time, or the second falling standby time is shorter than the first falling standby time.

2. The display device of claim 1, wherein a first time interval between a start time of the first rising section and a start time of the first falling section is longer than a second time interval between a start time of the second rising section and a start time of the second falling section.

3. The display device of claim 1, wherein a voltage of the first high level voltage section is lower than a voltage of the second high level voltage section.

4. The display device of claim 1, wherein a portion of the first gate signal bounded by the first rising section, the first high level voltage section, the first falling section and an extension line of the first low level voltage section has a first area, wherein a portion of the second gate signal bounded by the second rising section, the second high level voltage section, the second falling section and an extension line of the second low level voltage section has a second area, and wherein the first area of the portion of the first gate signal is substantially equal to the second area of the portion of the second gate signal within ±5%.

5. The display device of claim 1, wherein when the first rising standby time is shorter than the second rising standby time, the first falling standby time is substantially equal to the second falling standby time, or wherein when the second falling standby time is shorter than the first falling standby time, the first rising standby time is substantially equal to the second rising standby time.

6. The display device of claim 1, wherein a length of the first rising section of the first gate signal is longer than a length of the second rising section of the second gate signal.

7. The display device of claim 1, wherein a length of the first falling section of the first gate signal is shorter than a length of the second falling section of the second gate signal.

8. The display device of claim 1, wherein the gate driving circuit is further configured to output the first gate signal based on a first clock signal and output the second gate signal based on a second clock signal, and wherein the first clock signal and the second clock signal have a same rising length and a same falling length.

9. The display device of claim 1, wherein the gate driving circuit comprises:

a first gate output buffer circuit including a first clock input node to which a first clock signal is input, a low level voltage node to which a low level voltage is input, and a first gate output node at which the first gate signal is output;

a second gate output buffer circuit including a second clock input node to which a second clock signal is input, a low level voltage node to which the low level voltage is input, and a second gate output node to which the second gate signal is output; and a control circuit configured to control the first gate output buffer circuit and the second gate output buffer circuit, wherein the first gate output buffer circuit further includes a first pull-up transistor for controlling a connection between the first clock input node and the first gate output node, and a first pull-down transistor for controlling a connection between the low level voltage node and the first gate output node, wherein the second gate output buffer circuit further includes a second pull-up transistor for controlling a connection between the second clock input node and the second gate output node, and a second pull-down transistor for controlling a connection between the low level voltage node and the second gate output node, and wherein a gate node of the first pull-up transistor and a gate node of the second pull-up transistor are electrically connected to each other.

10. The display device of claim 9, wherein the gate driving circuit further comprises:

a first dummy gate output buffer circuit including the first clock input node, the low level voltage node, and a first dummy gate output node at which a first dummy gate signal is output; and a second dummy gate output buffer circuit including the second clock input node, the low level voltage node, and a second dummy gate output node at which a second dummy gate signal is output, wherein the first dummy gate output buffer circuit further includes a first dummy pull-up transistor for controlling a connection between the first clock input node and the first dummy gate output node, and a first dummy pull-down transistor for controlling a connection between the low level voltage node and the first dummy gate output node, and wherein the second dummy gate output buffer circuit further includes a second dummy pull-up transistor for controlling a connection between the second clock input node and the second dummy gate output node, and a second dummy pull-down transistor for controlling a connection between the low level voltage node and the second dummy gate output node.

11. The display device of claim 10, further comprising:

a first sensing capacitor coupled between the first dummy gate output node and the low level voltage node;

a second sensing capacitor coupled between the second dummy gate output node and the low level voltage node; and at least one analog-to-digital converter for measuring a voltage of the first dummy gate output node and measuring a voltage of the second dummy gate output node.

12. The display device of claim 10, further comprising a compensation circuit configured to:

compare a first sensing result of a voltage change over time of the first dummy gate output node and a second sensing result of a voltage change over time of the second dummy gate output node to generate a comparison result; and adjust at least one of the first rising standby time and the second rising standby time based on the comparison result, or adjust at least one of the first falling standby time and the second falling standby time based on the comparison result.

13. The display device of claim 1, further comprising:

a controller configured to output:

a generation clock signal including a plurality of generation pulses, and a modulation clock signal including a plurality of modulation pulses; and a level shifter configured to output:

a first clock signal rising in synchronization with a first generation pulse among the plurality of generation pulses, and the first clock signal falling in synchronization with a first modulation pulse among the plurality of modulation pulses, and a second clock signal rising in synchronization with a second generation pulse among the plurality of generation pulses, and the second clock signal falling in synchronization with a second modulation pulse among the plurality of modulation pulses, wherein the gate driving circuit is further configured to output the first gate signal based on the first clock signal and output the second gate signal based on the second clock signal, and wherein the controller is further configured to:

adjust a pulse timing of at least one of the first generation pulse and the second generation pulse to have the first rising standby time of the first gate signal be shorter than the second rising standby time of the second gate signal; or adjust a pulse timing of at least one of the first modulation pulse and the second modulation pulse to have the second falling standby time of the second gate signal be shorter than the first falling standby time of the first gate signal.

14. A gate driving circuit comprising:

a first gate output buffer circuit configured to output a first gate signal based on a first clock signal to a first gate line in synchronization with a first horizontal synchronization pulse;

a second gate output buffer circuit configured to output a second gate signal based on a second clock signal to a second gate line in synchronization with a second horizontal synchronization pulse after the first horizontal synchronization pulse; and a control circuit configured to control the first gate output buffer circuit and the second gate output buffer circuit, wherein the first gate signal includes a first low level voltage section, a first rising section, a first high level voltage section, and a first falling section, wherein the first rising section is started after a first rising standby time elapses from the first horizontal synchronization pulse, and the first falling section is started after a first falling standby time elapses from the first horizontal synchronization pulse, the first rising standby time being shorter than the first falling standby time, wherein the second gate signal includes a second low level voltage section, a second rising section, a second high level voltage section and a second falling section, wherein the second rising section is started after a second rising standby time elapses from the second horizontal synchronization pulse, and the second falling section is started after a second falling standby time elapses from the second horizontal synchronization pulse, the second rising standby time being shorter than the second falling standby time, and wherein the first rising standby time is shorter than the second rising standby time, or the second falling standby time is shorter than the first falling standby time.

15. The gate driving circuit of claim 14, wherein a portion of the first gate signal bounded by the first rising section, the first high level voltage section, the first falling section and an extension line of the first low level voltage section has a first area, wherein a portion of the second gate signal bounded by the second rising section, the second high level voltage section, the second falling section and an extension line of the second low level voltage section has a second area, and wherein the first area of the portion of the first gate signal is substantially equal to the second area of the portion of the second gate signal within ±5%.

16. The gate driving circuit of claim 14, wherein when the first rising standby time is shorter than the second rising standby time, the first falling standby time is substantially equal to the second falling standby time, or wherein when the second falling standby time is shorter than the first falling standby time, the first rising standby time is substantially equal to the second rising standby time.

17. The gate driving circuit of claim 14, wherein the first clock signal and the second clock signal have a same signal waveform.

18. The gate driving circuit of claim 14, wherein the first gate output buffer circuit comprises a first clock input node to which a first clock signal is input, a low level voltage node to which a low level voltage is input, and a first gate output node at which the first gate signal is output, wherein the second gate output buffer circuit comprises a second clock input node to which a second clock signal is input, a low level voltage node to which the low level voltage is input, and a second gate output node at which the second gate signal is output, wherein the first gate output buffer circuit further includes a first pull-up transistor for controlling a connection between the first clock input node and the first gate output node, and a first pull-down transistor for controlling a connection between the low level voltage node and the first gate output node, wherein the second gate output buffer circuit further includes a second pull-up transistor for controlling a connection between the second clock input node and the second gate output node, and a second pull-down transistor for controlling a connection between the low level voltage node and the second gate output node, and wherein the control circuit is further configured to control a voltage of a Q node shared by a gate node of the first pull-up transistor and a gate node of the second pull-up transistor, and is configured to control a voltage of a QB node shared by a gate node of the first pull-down transistor and a gate node of the second pull-down transistor.

19. The gate driving circuit of claim 18, further comprising:

a first dummy gate output buffer circuit including the first clock input node, the low level voltage node, and a first dummy gate output node at which a first dummy gate signal is output;

a second dummy gate output buffer circuit including the second clock input node, the low level voltage node, and a second dummy gate output node at which a second dummy gate signal is output;

a first sensing capacitor coupled between the first dummy gate output node and the low level voltage node; and a second sensing capacitor coupled between the second dummy gate output node and the low level voltage node, wherein the first dummy gate output buffer circuit further includes a first dummy pull-up transistor for controlling a connection between the first clock input node and the first dummy gate output node, and a first dummy pull-down transistor for controlling a connection between the low level voltage node and the first dummy gate output node, and wherein the second dummy gate output buffer circuit further includes a second dummy pull-up transistor for controlling a connection between the second clock input node and the second dummy gate output node, and a second dummy pull-down transistor controlling a connection between the low level voltage node and the second dummy gate output node.

20. A gate driving method comprising:

outputting, via a gate driving circuit, a first gate signal to a first gate line in synchronization with a first horizontal synchronization pulse; and outputting, via the gate driving circuit, a second gate signal to a second gate line in synchronization with a second horizontal synchronization pulse after the first horizontal synchronization pulse, wherein the first gate signal includes a first low level voltage section, a first rising section, a first high level voltage section, and a first falling section, wherein the first rising section is started after a first rising standby time elapses from the first horizontal synchronization pulse, and the first falling section is started after a first falling standby time elapses from the first horizontal synchronization pulse, the first rising standby time being shorter than the first falling standby time, wherein the second gate signal includes a second low level voltage section, a second rising section, a second high level voltage section, and a second falling section, wherein the second rising section is started after a second rising standby time elapses from the second horizontal synchronization pulse, and the second falling section is started after a second falling standby time elapses from the second horizontal synchronization pulse, the second rising standby time being shorter than the second falling standby time, and wherein the first rising standby time is shorter than the second rising standby time, or the second falling standby time is shorter than the first falling standby time.

21. A display device comprising:

a display panel including a first gate line and a second gate line; and a gate driving circuit configured to:

output a first gate signal to the first gate line in synchronization with a first horizontal synchronization pulse, output a second gate signal to the second gate line in synchronization with a second horizontal synchronization pulse after the first horizontal synchronization pulse, and adjust at least a portion of the first gate signal or at least a portion of the second gate signal so that an area under one pulse of the first gate signal is substantially equal to an area under one pulse of the second gate signal, wherein the area under the one pulse of the first gate signal has a different shape than the area under the one pulse of the second gate signal.

* * * * *